US007025837B2

(12) United States Patent
Makita et al.

(10) Patent No.: US 7,025,837 B2
(45) Date of Patent: Apr. 11, 2006

(54) PERMANENT MAGNETS AND R-TM-B BASED PERMANENT MAGNETS

(75) Inventors: Ken Makita, Osaka (JP); Osamu Yamashita, Osaka (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 10/256,166

(22) Filed: Sep. 27, 2002

(65) Prior Publication Data

US 2003/0136469 A1 Jul. 24, 2003

Related U.S. Application Data

(62) Division of application No. 09/265,669, filed on Mar. 10, 1999, now Pat. No. 6,511,552.

(30) Foreign Application Priority Data

| | | |
|---|---|---|
| Mar. 23, 1998 | (JP) | 10-95475 |
| Mar. 23, 1998 | (JP) | 10-95476 |
| Mar. 23, 1998 | (JP) | 10-95477 |
| May 11, 1998 | (JP) | 10-314665 |
| Jul. 27, 1998 | (JP) | 10-226538 |

(51) Int. Cl.
*H01F 1/057* (2006.01)

(52) U.S. Cl. ..... 148/302; 420/83; 420/121

(58) Field of Classification Search ..... 148/101, 148/105, 102, 104, 302, 301, 303; 420/83, 420/121

See application file for complete search history.

(56) References Cited

U.S. PATENT DOCUMENTS

| | | | | |
|---|---|---|---|---|
| 4,601,875 A | | 7/1986 | Yamamoto et al. | |
| 4,826,546 A | | 5/1989 | Yamamoto et al. | |
| 5,015,307 A | * | 5/1991 | Shimotomai et al. | 148/302 |
| 5,147,447 A | | 9/1992 | Takeshita et al. | |
| 5,183,630 A | | 2/1993 | Ueda et al. | |
| 5,433,795 A | * | 7/1995 | Panchanathan et al. | 148/101 |
| 5,437,741 A | * | 8/1995 | Ozaki et al. | 148/302 |
| 5,595,608 A | * | 1/1997 | Takebuchi et al. | 148/104 |
| 5,725,792 A | * | 3/1998 | Panchanathan | 252/62.54 |
| 5,769,969 A | | 6/1998 | Ishikawa et al. | |
| 5,849,109 A | * | 12/1998 | Ikeda | 148/122 |
| 5,858,124 A | | 1/1999 | Endo et al. | |
| 6,174,609 B1 | * | 1/2001 | Katsumi et al. | 428/450 |

FOREIGN PATENT DOCUMENTS

EP 0 395 625 A2 10/1990

(Continued)

OTHER PUBLICATIONS

"The microstructure of hot formed neodymium-iron-boron magnets with energy product 48 MG Oe," Raja K. Mishra et al., J. Appl. Phys. 73(10), May 15, 1993, pp:6470-6472.

(Continued)

*Primary Examiner*—John P. Sheehan
(74) *Attorney, Agent, or Firm*—Morrison & Foerster LLP

(57) ABSTRACT

Permanent magnets in which the ferromagnetic phase is matched with the grain boundary phase, and permanent magnets in which magnetocrystalline anisotropy in the vicinity of the outermost shell of the major phase is equivalent in intensity to that in the inside to suppress nucleation of the reverse magnetic domain, more specifically having a magnetocrystalline anisotropy not less than one-half the magnetocrystalline anisotropy of the interiors of the ferromagnetic grains, are disclosed.

5 Claims, 9 Drawing Sheets

FOREIGN PATENT DOCUMENTS

| | | |
|---|---|---|
| JP | 60-255941 | 12/1985 |
| JP | 3-219056 | 1/1990 |
| JP | 4-152504 | 10/1990 |
| JP | 5-326229 | 5/1992 |
| JP | 5-217744 | 8/1993 |
| JP | 5-247600 | 9/1993 |
| JP | 9-186010 | 8/1996 |
| JP | 10-163055 | 11/1996 |
| JP | 10-041116 | 2/1998 |

OTHER PUBLICATIONS

"High-resolution transmission electron microscopy observations on textured rapidly quenched NdFeB permanent magents," J. Appl. Phys. vol. 70 (1991), 15 No. 1991, No. 10, PT. II, pp: 6459-6461.

"Influence of oxygen on the structure of Nd-rich phase in the sintered $Nd_{15}Fe_{77}B_8$ magnet," J. Magnetism and Magnetic Materials, vol. 110 (1992), May, No. 3, pp: L261-L263.

"Diffusion-alloyed additives in die-upset Nd-Fe-B magnets," 69(8), Apr. 15, 1991, pp: 5826-5828.

Patent Abstracts of Japan, vol. 17, No. 653 (E-1469), Dec. 3 1993 & JP 05 217744 A (TDK Corp.), Aug. 27 1993, abstract only.

Patent Abstracts of Japan, vol. 18, No. 490 (C-1249), Sep 13, 1994 & JP 06 158238 A (Sumitomo Special Metals Co., Ltd.), Jun. 7, 1994, abstract only.

Gao et al. "Defect Models of Grain Structure and Coercivity Mechanism for NdFeB Permanent Magnetic Alloys" Metal Function Materials, 1997, No. 2, pp. 61-65.

Japanese Office Action dated Jul. 27, 2004, issued in counterpart JP 10-95475 with English translation of Examiner's remarks.

Japanese Office Action dated Jul. 27, 2004, issued in counterpart JP 10-314665 with English translation of Examiner's remarks.

* cited by examiner

PERMANENT MAGNETS AND R-TM-B BASED PERMANENT MAGNETS

REFERENCE TO RELATED APPLICATIONS

This application is a divisional of Ser. No. 09/265,669, filed Mar. 10, 1999 now U.S. Pat. No. 6,511,552. The prior application, in its entirety, is hereby incorporated by reference.

FIELD OF THE INVENTION

This invention relates to permanent magnets, R-TM-B based permanent magnets, where R is a rare earth element embracing Y and TM is a transition metal, and, more particularly, to a starting material thereof, an intermediate product thereof and an ultimate product thereof.

Additionally, this invention relates to rare-earth magnetic powders for bonded magnets and a manufacturing method thereof.

BACKGROUND

The mechanism used for generating the coercivity in permanent magnets currently under use may be enumerated by single magnetic domain particle type, nucleation type and pinning type mechanisms. Of these, the nucleation type coercivity generating mechanism has been introduced in order to account for generation of large coercivity in a sintered magnet having a crystal grain size not less than the single magnetic domain particle size, and is based on the theory that facility of nucleation of an demagnetizing field in the vicinity of the crystal grain boundary determines the coercivity of the crystal grain in question. This type of the magnet has peculiar magnetization properties that, while saturation of magnetization in the initial process of magnetization occurs at a lower impressed magnetic field, a magnetic field not less than the saturation magnetization needs to be applied to obtain sufficient coercivity. It may be presumed that the high magnetic field can drive off any demagnetizing field left in the crystal grain completely by a high magnetic field thus producing high coercivity. Examples of the magnet having the nucleation type coercivity generating mechanism include $SmCo_5$-based or Nd—Fe—B-based sintered magnets.

The R-TM-B based permanent magnet has superior magnetic properties, and is finding a wide field of usages. There are a variety of manufacturing methods for the R-TM-B based permanent magnet, the most representative one being a sintering method and a rapid solidification method. The sintering method, as disclosed in Japanese Laying-Open Patent Kokai JP-A-59-46008, is a method consisting in pulverizing an ingot of a specified composition to fine powders of single crystals with a mean particle size of several μm, consolidating the powders to an optional shape under magnetic orientation in a magnetic field, and sintering the green compact to a bulk magnet. The rapid solidification method, disclosed in Japanese Patent Kokai JP-A-60-9852, is a method consisting in rapidly solidifying an alloy of a specified composition by a method such as roll quenching method to an amorphous state followed by heat treatment to precipitate fine crystal grains. The magnet alloy obtained by the rapid solidification method is usually powdered and are routinely mixed with a resin and molded to produce bonded magnets.

Rare earth magnetic powders having the coercivity generating mechanism of the pinning type, such as $Sm_2Co_{17}$, can be processed into magnetic powders suitable for bonded magnets simply by pulverizing a molten ingot of a pre-set composition. On the other hand, in rare earth magnetic powders having the coercivity generating mechanism of the nucleation type, practically useful coercivity is not produced unless the crystal grain size of the powdered particles is set so as not to be larger than the single magnetic domain particle size. Thus, as a manufacturing method in which the $Nd_2Fe_{14}B$ crystal grain size in the powdered particles is less than the single magnetic domain particle size, there are currently used a rapid solidification method and a HDDR (hydrogenation-decomposition-dehydrogenation-recombination) method.

SUMMARY OF THE DISCLOSURE

The present inventors have found that the conventional techniques concerning the above-mentioned nucleation type magnet has the following disadvantages. That is, while it has been predicted that, in the conventional techniques, the coercivity of the nucleation type magnet is governed by nucleation of the demagnetizing field, sufficient information has not been acquired as to specified means for suppressing nucleation of the demagnetizing field to improve the coercivity. For instance, while it has been known that the presence of the Nd-rich grain boundary phase operates to improve the coercivity in the Nd—Fe—B based sintered magnet, its detailed mechanism has not been clarified.

In the above-described conventional techniques, sample preparation and evaluation are repeatedly carried out to optimize various conditions of the manufacturing process of the magnet to improve the magnetic properties of the magnet by an empirical route. However, with such an empirical method, it is difficult to achieve drastically improved magnetic properties. Moreover, if plural permanent magnets of different compositions are produced, the sample preparation and evaluation of the different magnets need to be repeatedly carried out for the respective magnets.

In the above-described a manufacturing method in which the $Nd_2Fe_{14}B$ crystal grain size in the powdered particles is less than the single magnetic domain particle size, the rapid solidification method and the HDDR method suffer from the defect that the investment costs for production equipment are high and the manufacturing conditions are severe to raise the cost.

It is an object of the present invention to provide a guide or key for the designing of high magnetic performance.

It is another object of the present invention to provide a guideline for the designing of the R-TM-B based permanent magnet having high magnetic performance.

It is a further object of the present invention to provide rare-earth magnetic powders for bonded magnets having high magnetic properties, and which can be manufactured inexpensively, and a manufacturing method thereof.

Heretofore, the structure of an interface governing the magnetic properties of a magnet, in particular its coercivity, between the major phase and the grain boundary phase, has not been clarified. In the present specification, the "major phase" means the "phase exhibiting the ferromagnetism". The major phase desirably accounts for not less than one half of the entire phase. Thus, in the conventional technique, various conditions of the magnet manufacturing process are optimized for empirically improving the magnetic properties of the magnet. This empirical technique is not only time-consuming and costly but also is encountered with limitations in further improving the magnetic properties.

The present inventors have conducted researches into the fundamental problem of what should be the ideal interface structure, without relying upon the empirical technique, and found that, in a variety of magnetic materials exhibiting nucleation type coercivity generating mechanism, the ease with which nucleation occurs depends on the magnitude of the magnetocrystalline anisotropy in the vicinity of the outermost shell of the magnetic phase, and that, by controlling the magnitude of the anisotropy constant $K_1$ in the vicinity of the outermost shell to be at least equal or larger than that in an interior region, the nucleation can be suppressed to improve coercivity of the magnet. This finding has led to completion of the present invention.

The First Group of the Present Invention

In a first aspect of the first group of the present invention, the ferromagnetic phase is matched with the grain boundary phase. In its second aspect of the first group, the atomic arrangement (orientation) is regular on both sides of an interface between the ferromagnetic phase and the grain boundary phase. In its third aspect of the first group, the grain boundary phase has a crystal type, a plane index and azimuthal index (crystal orientation) matched to the ferromagnetic phase. In its fourth aspect of the first group, the magnetocrystalline anisotropy at a lattice point of said ferromagnetic phase neighboring to the interface with the grain boundary phase is not less than one-half the magnetocrystalline anisotropy at the lattice point interior of said ferromagnetic phase.

In its fifth aspect of the first group, the magnetocrystalline anisotropy in the outermost shell of the ferromagnetic particles is not less than one-half that in the interior thereof. In its sixth aspect of the first group, the magnetocrystalline anisotropy in the outermost shell of the ferromagnetic crystal grains is higher than that in the interior thereof. In its seventh aspect of the first group, the magnetocrystalline anisotropy of the outer shell within five atomic layers from the outermost shell of the ferromagnetic crystal grains is higher than that in the interior thereof. In an eighth aspect of the first group, the magnetocrystalline anisotropy of the ferromagnetic crystal grains is displayed mainly by crystal fields arising from rare earth elements, and cations are located in the extending direction of the 4f electron cloud of rare earth element ions located at an outermost shell of the ferromagnetic crystal grains. In its ninth aspect of the first group, the cationic source is one or more of Be, Mg, Al, Si, P, Ca, Sc, Ti, V, Cr, Mn, Fe, Co, Ni, Cu, Zn, Ga, Sr, Zr, Nb, Mo, Cd, In, Sn, Ba, Hf, Ta, Ir or Pb.

In a tenth aspect of the first group of the present invention, a cationic source is added to ferromagnetic particles exhibiting magnetocrystalline anisotropy mainly by the crystal field of rare earth elements, a crystal containing the cationic source is precipitated at least in a grain boundary portion neighboring to ferromagnetic grains and cations are located in a transverse direction of the extending direction of the 4f electron cloud of rare earth element ions located at an outermost shell of grains ferromagnetic particles. In its eleventh aspect of the first group, the composition, crystal type, plane index and azimuthal index of the grain boundary phase in the state of co-existence of both the ferromagnetic phase and the grain boundary phase, are set in accordance with the crystal structure of the ferromagnetic phase so that the ferromagnetic phase will match with the grain boundary phase.

The present invention has, in its first aspect of the second group, the following elements, namely a magnetic phase mainly composed of $R_2TM_{14}B$ intermetallic compound having a tetragonal crystal structure (R: rare earth element including Y and TM: transition metal), and a grain boundary phase mainly composed of an R-TM alloy, with the crystal structure of the grain boundary phase in the vicinity of the interface between the magnetic phase and the grain boundary phase being a face-centered cubic structure, with the magnetic phase and the grain boundary phase matching with each other. In its second aspect of the second group, in the $R_2TM_{14}B$ intermetallic compound, the sum of Nd and/or Pr in R is not less than 50 at %, and TM is Fe and/or Co, with Fe in TM being at least 50, at %, and R in the R-TM alloy being not less than 90 at %. In its third aspect of the second group, the crystallographic orientation in the vicinity of the interface between the magnetic phase and the grain boundary phase is represented by at least a set of expressions (A) to (C):

(001) magnetic phase//(110) grain boundary phase and [110] magnetic phase//[001] grain boundary phase (A)

(001) magnetic phase//(221) grain boundary phase and [110] magnetic phase//[111] grain boundary phase (B)

(001) magnetic phase//(111) grain boundary phase and [100] magnetic phase//[110] grain boundary phase (C)

and wherein the angle of orientation deviation is not larger than 5°.

In its fourth aspect of the second group, the permanent magnet is composed that

R is 8 to 30 at %;

B is 2 to 40 at %; with the balance mainly being TM (particularly, Fe, Co).

In its fifth aspect of the second group, a magnetic phase has a crystal structure of a tetragonal structure and a grain boundary phase having a face-centered cubic crystal structure in the vicinity of an interface thereof with respect to the magnetic phase. The magnetic phase and the grain boundary phase are matched with each other interposed with an interface. In its sixth aspect of the second group, a source of an $R_2TM_{14}B$ intermetallic compound exhibiting ferromagnetic properties (R: rare earth element embracing Y, and TM: transition metal) and an R-TM alloy source are used as a starting material, and the $R_2TM_{14}B$ tetragonal crystal phase is precipitated, while further an R-TM face-centered cubic crystal phase is precipitated around the $R_2TM_{14}B$ tetragonal phase to match the $R_2TM_{14}B$ tetragonal phase and the R-TM face-centered cubic crystal phase to elevate the magnetocrystalline anisotropy of the $R_2TM_{14}B$ tetragonal phase in the vicinity of the matched (epitaxial) interface.

Taking an example of an R-TM-B based permanent magnet, mainly composed of the major phase (ferromagnetic phase) composed of an $R_2TM_{14}B$ intermetallic compound (preferably single crystal) and the grain boundary phase composed of a grain boundary phase composed of an R-TM alloy, the principle in the second group of the present invention is explained. In a known manner, there exist in the R-TM-B based permanent magnet a B-rich phase ($R_{1+\alpha}TM_4B_4$), R-TM meta-stable phase, oxides inevitably entrained in the process, and carbides, in addition to the above-mentioned major phase and the grain boundary phase. However, the effects of these phases on the magnetic properties of the permanent magnet are of subsidiary nature as compared to two phases of the major phase and the grain boundary phase.

The presence of the grain boundary phase is indispensable for the demonstration of practically useful coercivity. Generally the coercivity decreases as the R component in the magnet composition gets short, the R being required for forming the grain boundary phase. The reason is possibly that the two phases, namely the $R_2TM_{14}B$ phase and the R-TM phase cease to be able to co-exist in the equilibrium state due to shortage of the R component and that, in its stead, the ferromagnetic phase such as $R_2TM_{17}$ phase is precipitated in the grain boundary of the $R_2TM_{14}B$ phase to form an origin of generation of the demagnetizing field (inverse magnetic domain) to produce inversion of magnetization easily to lead to a lowered coercivity. The compositional region in which the above-mentioned $R_2TM_{14}B$ phase and the R-TM phase coexist may be known from the R—Fe—B ternary equilibrium diagram.

For affording practically sufficient coercivity to the R-TM-B based permanent magnet, prepared by the sintering method, it has been known necessary that the major phase as the ferromagnetic phase be contacted with the grain boundary phase at a smooth interface free of lattice defects, as has been clarified by microscopic observation of the interface over a transmission electron microscope. The reason is that, if there is a lattice defect in the interface, this lattice defect becomes the source of generation of the reverse magnetic domain to induce inversion of magnetization easily to lower the coercivity.

The present inventors have found that there exists the following problem in displaying superior magnetic properties proper to the R-TM-B based permanent magnet of the above-mentioned prior art. That is, although the information on the composition range where there exists the R-TM grain boundary phase or on the possible presence of the defects in the interface between the major phase and the grain boundary phase has been acquired in the prior art, there lacked the knowledge as to the crystal structure or the R-TM grain boundary phase or the desirable relative orientation with respect to the major phase. Therefore, it has not been possible to control the microscopic structure of the R-TM-B based permanent magnet having the specified composition to display superior magnetic properties. Instead, the various conditions of the magnet manufacturing process are optimized in the prior art with a view to empirically improving magnetic properties of the magnet.

That is, the magnetic properties of the magnet, in particular the structure of the interface between the major phase governing the coercivity and the grain boundary phase, were not known in the prior art. Thus, a variety of processing operations felt to vary the interface structure, such as heat treatment, are performed on the magnet to control the properties of the magnet, with the interface state remaining as a black box. Although this technique is not obstructive to the optimization of the manufacturing conditions of the magnets of various compositions, it is extremely difficult to improve the properties of the magnet further in the absence of the material development guideline as to what should be the ideal interface structure.

The present inventors have conducted microscopic analyses of the grain boundary phase of a variety of R-TM-B based permanent magnet, using a transmission electron microscope (TEM), and found that, in the grain boundaries of all R-TM-B based permanent magnets, there necessarily exists a grain boundary phase composed of a R-TM alloy (generally, containing not less than 90 at % of R), and that superior magnetic properties can be realized when the crystal structure of the grain boundary phase in the vicinity of the interface relative to the major phase assumes a face-centered cubic structure.

The present inventors also conducted detailed scrutiny into the structure of the interface between the grain boundary phase of the R-TM-B based permanent magnet having the R-TM grain boundary phase of the above-mentioned face-centered cubic structure and the major phase ($R_2TM_{14}B$ phase) by observation over a high resolution transmission electron microscope (HR-TEM) or a scanning tunnel microscope, and found that the magnetic properties are optimum when the microscopic structure of the permanent magnet is controlled so that the major phase and the grain boundary phase will have a specified relative crystallographic orientation in the vicinity of the interface to be matched with each other. The present invention has been brought to completion on the basis of this finding and our further perseverant researches.

The present invention has, in its first aspect of the third group, the following elements, namely a magnetic phase mainly composed of $R_2TM_{14}B$ intermetallic compound having a tetragonal crystal structure (R: rare earth element embracing Y, and TM: transition metal), and a grain boundary phase mainly composed of an $R_3TM$ alloy, with the crystal structure of a portion of the grain boundary phase in the vicinity of the interface between the magnetic phase and the grain boundary phase being a rhombic structure, with the magnetic phase and the grain boundary phase matching with to each other. In its second aspect of the third group, in the $R_2TM_{14}B$ intermetallic compound, the sum of Nd and/or Pr in R is not less than 50 at %, and TM is Fe and/or Co, with Fe in TM accounting for not less than 50 at %. In its third aspect of the third group, in the $R_2TM_{14}B$ intermetallic compound, Fe in TM accounts for not less than 50 at % and Co in TM is not less than 0.1 at % and, in the $R_3TM$ intermetallic compound, Co in TM is not less than 90 at %. In its fourth aspect, the crystallographic orientation in the vicinity of the interface between the magnetic phase and the grain boundary phase is represented by at least a set of expressions (F) to (I):

(001)magnetic phase//(001)grain boundary phase and [110]magnetic phase//[110]grain boundary phase (F)

(001)magnetic phase//(110)grain boundary phase and [110]magnetic phase//[001]grain boundary phase (G)

(001)magnetic phase//(221)grain boundary phase and [110]magnetic phase//[111]grain boundary phase (H)

(001)magnetic phase//(111)grain boundary phase and [110]magnetic phase//[110]grain boundary phase (I)

with the angle of orientation deviation being not larger than 5°.

In its fifth aspect of the second group, the permanent magnet is composed that

R is 8 to 30 at %;

B is 2 to 40 at %;

Fe is 40 to 90 at %; and

Co is 50 or less.

In its sixth aspect of the third group, the crystal structure contains a magnetic phase having the crystal structure of a tetragonal system and a grain boundary phase having a crystal structure of a rhombic system in the vicinity of an interface to the magnetic layer. The magnetic phase is matched with the grain boundary phase interposed with the interface. In its seventh aspect of the third group, the present invention includes employing a source of an $R_2TM_{14}B$ intermetallic compound exhibiting ferromagnetic properties (R: rare earth element embracing Y; TM: transition metals) and an R-TM alloy source, as a starting material, precipitating an $R_2TM_{14}B$ tetragonal crystal phase and precipitating the $R_3TM$ rhombic phase around said $R_2TM_{14}B$ tetragonal crystal phase for matching the $R_3TM$ rhombic phase to the $R_2TM_{14}B$ tetragonal crystal phase for elevating magnetocrystalline anisotropy of the $R_2TM_{14}B$ tetragonal crystal phase in the vicinity of the matched interface.

Taking an example of an R-TM-B based permanent magnet, mainly composed of the major phase (ferromagnetic phase) composed of an $R_2TM_{14}B$ intermetallic compound (preferably single crystal) and the grain boundary phase composed of a grain boundary phase composed of an $R_3TM$ alloy, the principle in the third group of the present invention is explained. In a known manner, there exist in the R-TM-B based permanent magnet a B-rich phase ($R_{1+\alpha}TM_4B_4$), R-TM meta-stable phase, and oxides, inevitably entrained in the process, and carbides, in addition to the above-mentioned major phase and the grain boundary phase. However, the influences of these phases on the magnetic properties of the permanent magnet are of subsidiary nature as compared to two phases of the major phase and the grain boundary phase.

In an R-TM-B based permanent magnet, it is known that the Curie temperature is raised and corrosion resistance is improved by having Co contained in TM, such that it is a known technique to add a suitable amount of Co to the R-TM-B based permanent magnet to this end. In addition to the above methods of processing the R-TM-B based permanent magnet, there are a variety of known methods, such as mechanical-alloying method, hot pressing method, hot rolling method and a HDDR method. However, all of the R-TM-B based permanent magnets are made up of at least two phases, that is a major phase of a single crystal of an $R_2TM_{14}B$ intermetallic compound and a grain boundary phase, such as an $R_3TM$ intermetallic compound phase.

The presence of the grain boundary phase is indispensable for the demonstration of coercivity of a magnet. Generally, the coercivity decreases as the R component necessary for forming the boundary phase becomes short. The reason is possibly that the two phases, namely the $R_2TM_{14}B$ phase and the $R_3TM$ phase cease to be able to co-exist in the equilibrium state due to shortage of the R component and that, in its stead, the ferromagnetic phase such as $R_2TM_{17}$ phase is precipitated in the grain boundary of the $R_2TM_{14}B$ phase to form an origin of generation of the inverse magnetic domain to produce inversion of magnetization easily to lead to lowered coercivity.

The presence of the grain boundary phase is indispensable for the demonstration of practically useful coercivity. The reason is possibly that the two phases, namely the $R_2TM_{14}B$ phase and the R-TM phase cease to be able to co-exist in the equilibrium state due to shortage of the R component and that, in its stead, the ferromagnetic phase such as $R_2TM_{17}$ phase is precipitated into the grain boundary of the $R_2TM_{14}B$ phase to form an origin of generation of the inverse magnetic domain to produce inversion of magnetization easily to lead to lowered coercivity. The region of the composition in which the above-mentioned $R_2TM_{14}B$ phase and the R-TM phase coexist may be known from the R—Fe—B ternary equilibrium diagram.

The present inventors have found that there exists the following problem in displaying superior magnetic properties proper to the R-TM-B based permanent magnet of the aforementioned prior art. That is, although the information on the composition range where there exists the $R_3TM$ grain boundary phase or on the possible presence of the defects in the interface between the major phase and the grain boundary phase has been acquired in the prior art, there lacked the knowledge as to the crystal structure or the $R_3TM$ grain boundary phase or the desirable relative orientation with respect to the major phase. Therefore, it has not been possible to control the microscopic structure of the R-TM-B based permanent magnet having the specified composition to display superior magnetic properties. Instead, the Various conditions of the magnet manufacturing process are optimized in the prior art with a view to empirically improving magnetic properties of the magnet.

That is, the magnetic properties of the magnet, in particular the structure of the interface between the major phase governing the coercivity and the grain boundary phase, were not known in the prior art. Thus, a variety of processing operations felt to vary the interface structure, such as heat treatment, are performed on the magnet to control the properties of the magnet, with the interface state remaining as a black box. Although this technique is not obstructive to the optimization of the manufacturing conditions of the magnets of various compositions, it is extremely difficult to improve the properties of the magnet further in the absence of the material development guideline as to what should be the ideal interface structure.

The present inventors have conducted microscopic analyses of the grain boundary phase of a variety of R-TM-B based permanent magnets, using a transmission electron microscope (TEM), and found that, in the grain boundaries of all Co-containing R-TM-B based permanent magnets, there necessarily exists a grain boundary phase composed of a $R_3TM$ intermetallic compound having a rhombic crystal system, with Co in TM of a $R_3TM$ being not less than 90 at %, and that superior magnetic properties can be realized when the major face contacts the grain boundary phase interposed with an interface.

The present inventors also conducted detailed scrutiny into the structure of the interface between the grain boundary phase of the R-TM-B based permanent magnet having the $R_3TM$ grain boundary phase of the above-mentioned rhombic structure and the major phase ($R_2TM_{14}B$ phase) by observation over a high resolution transmission electron microscope (HR-TEM) or a scanning tunnel microscope, and found that the magnetic properties are optimum when the microscopic structure of the permanent magnet is controlled so that the major phase and the grain boundary phase will have a specified relative crystallographic orientation in the vicinity of the interface to be matched with each other.

In its first aspect of the forth group, the present invention provides an R-TM-B based permanent magnet composed of a magnetic phase mainly containing an $R_2TM_{14}B$ intermetallic compound having a tetragonal crystal structure (R: rare earth element including Y; TM: transition metal) and a grain boundary phase containing an R-TM-O compound, wherein the crystal structure of the grain boundary phase in the vicinity of an interface between the magnetic phase and the grain boundary phase is of face-centered cubic structure, and wherein the grain boundary phase is matched with the magnetic phase.

In the second aspect of the forth group, the R-TM-O compound is precipitated in the vicinity of the interface in the grain boundary phase. In the third aspect of the forth group, in the $R_2TM_{14}B$ intermetallic compound, the sum of Nd and/or Pr in R is not less than 50 at %, TM is Fe and/or Co, and Fe in TM is not less than 50at % and, in the R-TM-O compound, the ratio of R to the sum of R and TM is not less than 90 at %, the ratio of O is not less than 1 at % and not larger than 70 at %. In the fourth aspect of the forth group, the crystallographic orientation in the vicinity of an interface between the magnetic phase and the grain boundary phase is represented by at least a set of expressions (A) to (C):

(001)magnetic phase//(110)grain boundary phase and [110]magnetic phase//[001]grain boundary phase (A)

(001)magnetic phase//(221)grain boundary phase and [110]magnetic phase//[111]grain boundary phase (B)

(001)magnetic phase//(111)grain boundary phase and [100]magnetic phase//[110]grain boundary phase (C)

wherein the angle of deviation in the crystallographic orientation is less than 5°.

In its fifth aspect of the second group, the permanent magnet is composed that

R is 8 to 30 at %;

B is 2 to 40 at %; with

Fe is 40 to 90 at %; and

Co is 50 at % or less.

In the sixth aspect of the forth group, the permanent magnets contains a magnetic phase having a tetragonal system and a grain boundary phase in which there exists an oxygen-containing crystal structure having a face-centered cubic structure in the vicinity of an interface to the magnetic phase, the magnetic phase matching with the grain boundary phase with the interface in-between.

In its seventh aspect of the forth group, the present invention includes precipitating an $R_2TM_{14}B$ tetragonal crystal phase from an alloy containing R (rare earth element including Y), TM (transition metals), B and O and precipitating an R-TM-O face-centered cubic structure around the $R_2TM_{14}B$ tetragonal crystal phase such as to match the R-TM-O face-centered cubic structure to the $R_2TM_{14}B$ tetragonal crystal phase to elevate magnetocrystalline anisotropy of the $R_2TM_{14}B$ tetragonal crystal phase in the vicinity of the epitaxial interface. Preferably, a source of an $R_2TM_{14}B$ intermetallic compound exhibiting ferromagnetism (R: rare earth element including Y, and TM is a transition metal) and a source of the R-TM-O compound is used as a starting material.

Taking an example of an R-TM-B based permanent magnet, composed of the major phase (ferromagnetic phase) mainly composed of an $R_2TM_{14}B$ intermetallic compound (preferably single crystal) and the grain boundary phase composed of an R-TM-O compound, the principle in the fourth group of the present invention is explained. In a known manner, there exist in the R-TM-B based permanent magnet a B-rich phase ($R_{1+\alpha}TM_4B_4$), an R-TM meta-stable phase, and oxides and carbides, in addition to the aforementioned major phase and the grain boundary phase. However, the effects of these phases on the magnetic properties of the permanent magnet are of subsidiary nature.

The presence of the grain boundary phase is indispensable for the demonstration of practically useful coercivity. Generally, the coercivity decreases as the R component in the magnet composition necessary for forming the grain boundary phase becomes short. The reason is possibly that the two phases, namely the $R_2TM_{14}B$ phase and the R-TM phase cease to be able to co-exist in the equilibrium state due to shortage of the R component and that, in its stead, the ferromagnetic phase such as $R_2TM_{17}$ phase is precipitated into the grain boundary of the $R_2TM_{14}B$ phase to form an origin of generation of the inverse magnetic domain to produce inversion of magnetization easily to lead to lowered coercivity. The region of the composition in which the above-mentioned $R_2TM_{14}B$ phase and the R-TM phase coexist may be known from the R—Fe—B ternary equilibrium diagram.

For affording practically sufficient coercivity to the R-TM-B based permanent magnet, prepared by the sintering method, it has been found necessary that the major phase as the ferromagnetic phase be contacted with the grain boundary phase at a smooth interface free of lattice defects, as has been clarified by microscopic observation of the interface over a transmission electron microscope. The reason is that, if there is a lattice defect in the interface, this lattice defect becomes the source of generation of the reverse magnetic domain to induce inversion of magnetization easily to lower the coercivity.

The present inventors have found that there exists the following problem in displaying superior magnetic properties proper to the R-TM-B based permanent magnet of the above-mentioned prior art. That is, although the information on the composition range where there exists the R-TM grain boundary phase or on the possible presence of the defects in the interface between the major phase and the grain boundary phase has been acquired in the prior art, there lacked the knowledge as to the crystal structure or the R-TM grain boundary phase or the desirable relative orientation with respect to the major phase. Therefore, it has not been possible to control the microscopic structure f the R-TM-B based permanent magnet having the specified composition to display superior magnetic properties. Instead, the various conditions of the magnet manufacturing process are optimized in the prior art with a view to empirically improving magnetic properties of the magnet.

The present inventors also conducted detailed scrutiny into the structure of the interface between the grain boundary phase of the R-TM-B based permanent magnet having the R-TM grain boundary phase of the above-mentioned face-centered cubic structure and the major phase ($R_2TM_{14}B$ phase) by observation over a high resolution transmission electron microscope (HR-TEM) or a scanning tunnel microscope, and found that the magnetic properties are optimum when the microscopic structure of the permanent magnet is controlled so that the major phase and the grain boundary phase will have a specified relative crystallographic orientation in the vicinity of the interface to be matched with each other. The present invention has been brought to completion on the basis of this finding and our further perseverant researches.

The present inventors have conducted microscopic analyses on the grain boundary phase of a variety of R-TM-B based permanent magnets, using a transmission electron microscope (TEM), and found that, in the grain boundaries of R-TM-B based permanent magnets, and that superior magnetic properties can be realized, if there exists a grain boundary phase composed of a R-TM-O alloy containing not less than 90 at %, and the crystal structure of a portion of the grain boundary phase in the vicinity of the interface relative to the major phase has a face-centered cubic structure.

The present inventors also conducted detailed scrutiny into the structure of the interface between the grain boundary phase of the R-TM-B based permanent magnet having the R-TM-O grain boundary phase of the above-mentioned face-centered cubic structure and the major phase ($R_2TM_{14}B$ phase) by observation over a high resolution transmission electron microscope (HR-TEM) or a scanning tunnel microscope, and found that the magnetic properties are optimum when the microscopic structure of the permanent magnet is controlled so that the major phase and the grain boundary phase will have a specified relative crystallographic orientation in the vicinity of the interface. The present invention has been brought to completion on the basis of this finding and our further perseverant researches.

In the first aspect of the fifth group of this present invention, the present invention provides rare-earth magnetic powders for bonded magnets wherein alkaline earth metals exist in an interface of an $R_2TM_{14}B$ phase (R: rare earth element including Y and TM is a transition metal) in a epitaxial state relative to the $R_2TM_{14}B$ phase.

In the other aspect of the fifth group of this present invention, the present invention provides rare-earth magnetic powders for bonded magnets wherein the crystallographic orientation in the vicinity of an interface between the magnetic phase and said alkaline earth metal phase is represented by at least a set of expressions (A) to (E):

(001)major phase//(110)grain boundary phase and [110]major phase//[001]grain boundary phase (A)

(001)major phase//(221)grain boundary phase and [110]major phase//[111]grain boundary phase (B)

(001)major phase//(111)grain boundary phase and [100]major phase//[110]grain boundary phase (C)

(001)major phase//(201)grain boundary phase and [110]major phase//[010]grain boundary phase (D)

(001)major phase//(223)grain boundary phase and [110]major phase//[110]grain boundary phase (E).

In the further aspect of the fifth group of this present invention, the present invention provides a method for producing rare-earth magnetic powders for bonded magnets including the steps of impregnating alkaline earth metal in powders mainly composed of magnetic powders containing the $R_2TM_{14}B$ phase (R: rare earth element including Y, and TM: transition metal).

In the present specification, the statement "alkaline earth metal exists" means not only a case in which an alkaline earth metal exists by itself, but also a case in which it exists as an alloy, a compound or a mixed state thereof.

The present inventors have found that, if an $Nd_{2+x}Fe_{14}B$ compound (x=0.0 to 0.2) is dissolved, the ingot is pulverized to a pre-set particle size and Ca metal is impregnated into the powders from the particle surface, coercivity can be improved significantly as compared to the case where Nd metal is impregnated. The present invention has been completed on the basis of this finding and on our further researches.

According to the fifth group of the present invention, it is possible to provide high coercivity magnetic powders of $R_2TM_{14}B$ based rare earth elements directly exploiting features of the nucleation type rare earth element without forcibly pulverizing the nucleation type rare earth element magnetic powders into a pinning type rare earth element magnetic powders having a reduced crystal grain size. In addition, since the production process of the magnetic powders of $R_2TM_{14}B$ based rare earth elements is simplified, the production costs are lowered and the product quality is stabilized.

Referring to FIGS. 1 and 2A and 2B, the difference between the distribution of magnetocrystalline anisotropy in the neighborhood of the interface with the major phase (or ferromagnetic phase) matching to the grain boundary phase (such as R-TM, $R_3TM$, R-TM-O and Ca metals) and that with the major phase (or ferromagnetic phase) mismatching to the grain boundary phase is explained. In FIGS. 1 and 2A and 2B, the "outermost shell" denotes the position of an outermost atomic layer of the major phase, while the "second layer" and the "third layer" denote second and third atomic layers as counted from the outermost shell position towards the inside, respectively. The nth layer denotes a position remote from the outermost shell such that the effect from the interface is negligible. In the graph of FIG. 1, the ordinate denotes the intensity of the uniaxial magnetic anisotropy constant $K_1$ representing the intensity of the magnetocrystalline anisotropy. The larger the value of $K_1$, the more the orientation of the major phase is stabilized in the direction of easy axis (c-axis direction). Also, in FIG. 1, the Example (inventive) shows calculated values of $K_1$ under the condition of the major phase and the grain boundary phase matching with each other on the interface, as shown in FIG. 2A, while the Comparative Example shows the calculated value of $K_1$ when the interface mismatching exists due to dropout of the grain boundary phase or the like as shown in FIG. 2B.

Referring to FIG. 1, the magnitude of the anisotropic constant $K_1$ varies significantly in the Comparative Example with the distance from the interface, with the value of $K_1$ in the outermost shell being significantly lowered from the value in the interior. In the Example, the magnitude of the anisotropic constant $K_1$ is not significantly changed with the distance from the interface. Rather, the anisotropic constant $K_1$ is increased in the outermost shell phase. Therefore, in the Comparative Example, the energy required for nucleation of the inverse magnetic domain (demagnetizing field) is locally lowered to facilitate nucleation and inversion of magnetization, thus lowering the coercivity of the magnet. In the Example, $K_1$ in the outermost shell is somehow higher than that in the interior, thus suppressing nucleation of the inverse magnetic domain in the interface to increase coercivity of the magnet.

The meritorious effect of the present invention are summarized as follows.

The present invention provides a guideline for designing permanent magnets having high magnetic performance, in particular coercivity. Up to now, the structure of the interface between the major phase and the grain boundary phase responsible for coercivity was not known. Since the ideal interface structure for improving the coercivity has been clarified by the present invention, a new guideline for developing permanent magnets is provided, while the pre-existing permanent magnet (particularly, R-TM-B based one) can be improved further in coercivity. The result is that novel permanent magnet materials can be found easily, while permanent magnet (particularly, R-TM-B based one), so far not used practically because of the low coercivity, can be put to practical use, and an optimum composition can be determined easily.

With the R-TM-B based permanent magnet according to the present invention, the relative position between atoms in the interface between the major and grain boundary phases is regular and matched with each other, thereby decreasing the possibility of the interface operating as an originating point of the inverse magnetic domain (demagnetizing field) to achieve high coercivity. Also, the R-TM-B based permanent magnet according to the present invention has superior magnetic properties since specified crystal orientation between the ferromagnetic phase and the grain boundary phase strengthens the crystal field of the R atom in the major phase in the vicinity of the interface to raise the magnetocrystalline anisotropy in the vicinity of the interface of the major phase so that the inverse magnetic domain in the vicinity of the grain boundary can hardly be produced to render facilitated inversion of magnetization difficult.

The magnetic powders of the rare earth element for bonded magnets, obtained with the present invention, are superior in magnetic properties as compared to those obtained with the conventional rapid solidification method or HDDR method and can be manufactured by a simpler method. Therefore, by applying the powders of the present invention, the rare earth element bonded magnets can be produced at a lower cost to provide inexpensive rare earth element bonded magnets with high magnetic properties. The inventive powders are particularly useful as the magnetic powders for high coercivity materials. In the midst of a demand for magnet size reduction, the present invention provides a technique useful for improving coercivity of the ultra-small-sized $Nd_2TM_{14}$ B based magnet.

DETAILED DESCRIPTION OF THE PREFERRED EMBODYMENTS

Figure 1:
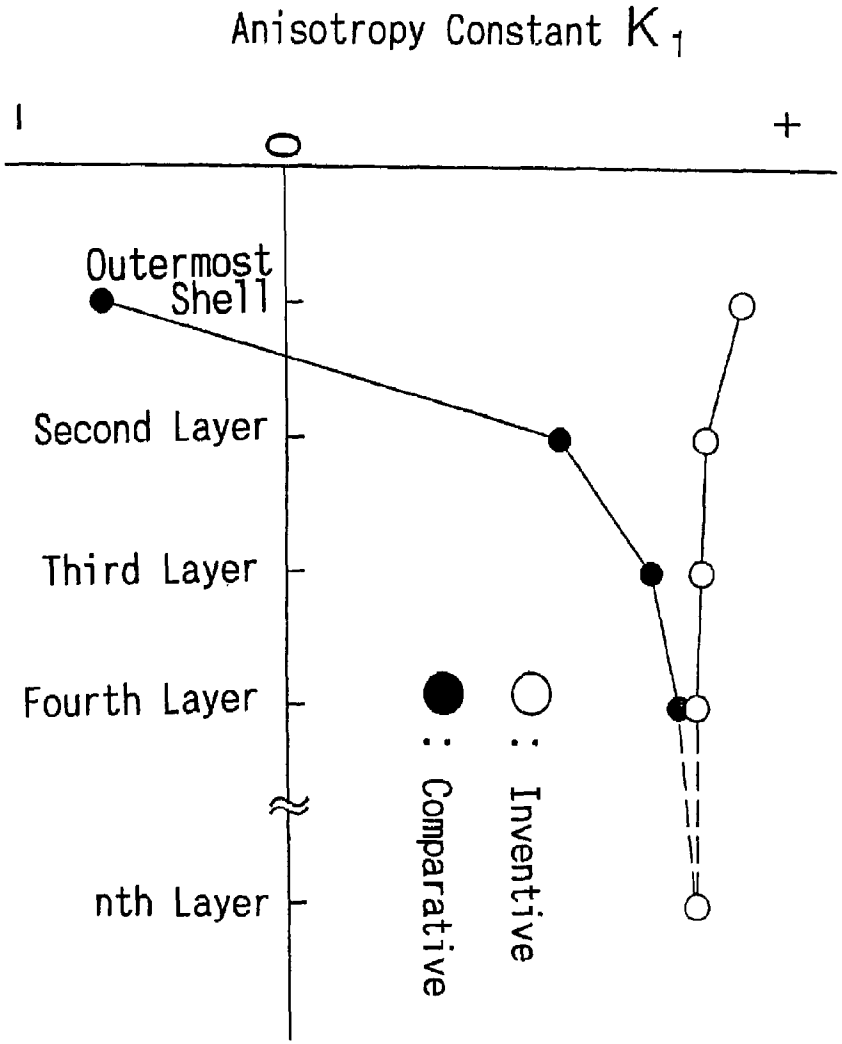
FIG. 1 illustrates the relation between the distance from an interface and magnetocrystalline anisotropy, with white circles and black circles specifying uniaxial anisotropic constants $K_1$ of Example of the invention and Comparative Example.
Figure 2:
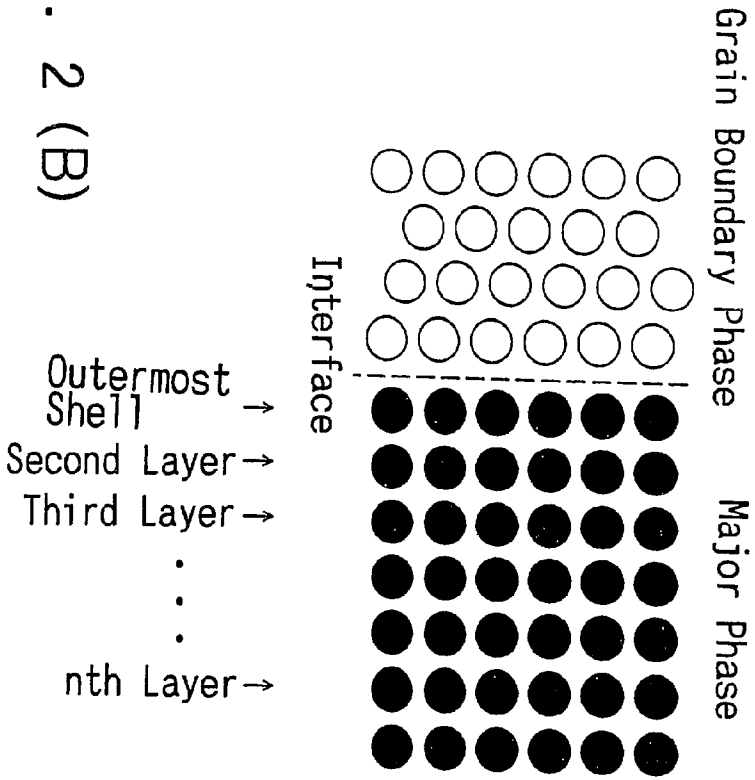
FIGS. 2A and 2B show a model showing how the major phase is matched with the grain boundary phase and how the major phase is mismatched with the grain boundary phase.
Figure 2:
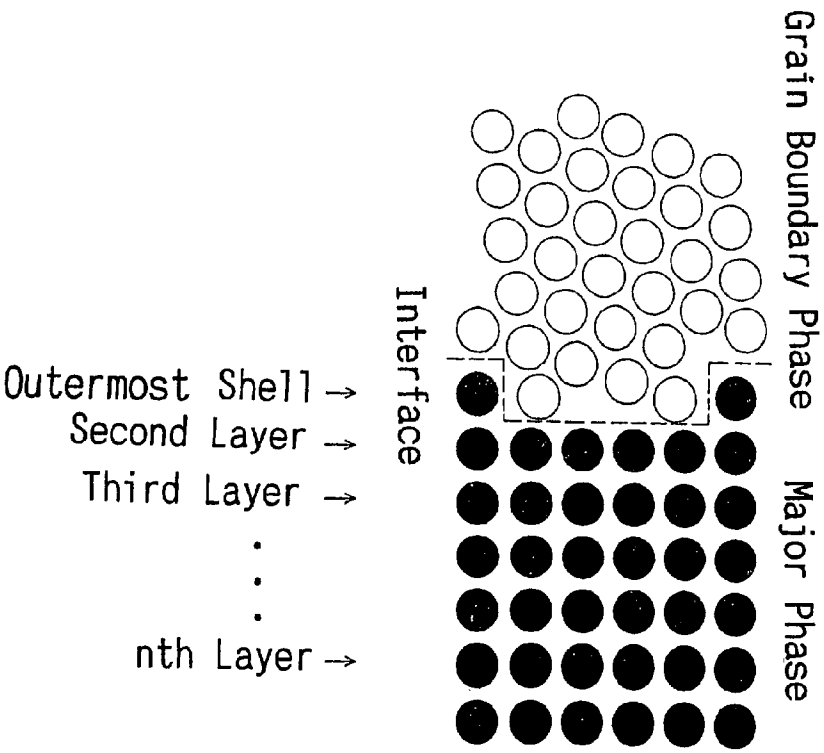

For more ideally controlling the relative position of atoms in the interface between the major phase and the grain boundary phase, it is sufficient if the relative crystallographic orientation of the main phase and the grain boundary phase is specified. The symbol "[hkl]" means the direction of a normal line perpendicular to the crystal plane represented by the Miller indices h, k, l. The suffices "main phase" and "grain boundary phase" mean that the respective directions are those of the major phase and the grain boundary phase, respectively. For example, the symbol "[001] major phase" means the direction of the c-axis of the $R_2TM_{14}B$ phase as the major phase. The symbol "//" entered between a set of directions specifies that these directions are parallel to each other.

The symbol "(hkl)" means a crystal plane represented by the Miller indices h, k, l. The meanings of the suffices "major phase" and "grain boundary phase" and the symbol "//" are the same as those for the direction. In expressing the direction for the same phase and the crystal plane, the Miller indices used denote the specified crystal direction or crystal plane, without being generalized indices.

For example, the Miller indices, shown below, are indices based on the fixed x, y, z coordinates of the grain boundary phase. In other words, the (221) plane and the (212) plane are distinguished strictly from each other. With this notation, the spatial relative orientation of the major phase and the grain boundary phase is prescribed strictly.

symbol "(221) grain boundary phase" and symbol "[111$\bar{1}$] grain boundary phase"

An embodiment of the present invention is hereinafter explained. The present invention, however, is not limited to the specified composition, recited below, but provides a guideline for the permanent magnet and the manufacturing method thereof in general. Although the present invention is applied to a nucleation type permanent magnet, it may also be applied to a single magnetic domain particle theory type or to the pinning type. The nucleation type permanent magnet may be exemplified by Nd—Fe—B, such as $Nd_2Fe_{14}B$, $Sm_2Fe_{17}N$ and $SmCo_5$. By way of an example, the reason the presence of the grain boundary phase in the $Nd_2Fe_{14}B$ phase elevates magnetocrystalline anisotropy of the major phase in the vicinity of the interface is explained.

Function of the Grain Boundary Phase

The magnetocrystalline anisotropy of the $Nd_2Fe_{14}B$ phase, as the major phase of the Nd—Fe—B magnet, depends on the position of the Nd atom in the crystal. The Nd and B atoms are present only on the bottom plane and $z=\frac{1}{2}c_0$ plane of a $Nd_2Fe_{14}B$ tetragonal lattice. The Nd atoms are present as $Nd^{3+}$ ions since electrons are emitted in the crystal.

4f electrons of $Nd^{3+}$ present spatial distribution spread in a doughnut shape, with the orientation of the magnetic moment J being perpendicular to the plane of spreading of the electron cloud. Since the doughnut-like electron cloud of 4f electrons of $Nd^{3+}$ ions is pulled by +charges of neighboring $Nd^{3+}$ ions or $B^{3+}$ ions in the bottom plane and hence is fixed in a direction perpendicular to the magnetic moment J, that is in the c-axis direction. This accounts for strong uniaxial magnetic anisotropy of the $Nd_2Fe_{14}B$ phase. In a compound of light rare earths, such as Nd, with a transition metal, such as Fe, the magnetic moment of the two tend to be aligned parallel to each other by the exchange action, as a result of which the magnetic moment of the entire $Nd_2Fe_{14}B$ phase is oriented in the c-axis direction.

If the outermost shell of the $Nd_2Fe_{14}B$ crystal, not coexisting with the grain boundary phase, is considered, the numbers of neighboring $Nd^{3+}$ or $B^{3+}$ ions are smaller for the outermost $Nd^{3+}$ ions than that for the inner $Nd^{3+}$ ions. Consequently, the force which fixes the spreading of the 4f electron cloud in the bottom plane direction is weak, as a result of which the magnetic moment is fixed with only an insufficient force in the c-axis direction. In the outermost shell area, the magnetocrystalline anisotropy is locally significantly lowered, so that the energy required for nucleation of the inverse magnetic domain is lowered to facilitate nucleation to lower the magnet coercivity.

If the grain boundary phase, such as Ca metal, exists neighboring to the outermost shell of the major phase, cations are present in the neighboring positions in place of the lacking $Nd^{3+}$ or $B^{3+}$ ions, so that the magnetocrystalline anisotropy is higher than the case where the grain boundary phase is totally absent. In particular, if the relative positions of the two phases is such that strong cations of the grain boundary phase are positioned in the vicinity of the a-axis direction of the $Nd^{3+}$ ions of the outermost shell of the major phase, the $K_1$ value is higher than that in the interior of the major phase, thus realizing a magnet of high coercivity. The above-mentioned desirable relative position tends to prevail at a higher rate of occurrence if the major phase is adjacent to the grain boundary phase on an epitaxial interface and the two phases are of a specified crystal orientation relative to each other.

If the cations of the grain boundary phase are arranged in the vicinity of the c-axis direction of the $Nd^{3+}$ ions of the major phase, magnetocrystalline anisotropy is lowered. However, in an actual interface, the layering sequence in the c-axis direction is such that the grain boundary phase is layered on the Fe atom layer of the major phase, without the grain boundary phase being layered in adjacency to the Nd atom layer of the major phase. Thus, the charges of the cations of the grain boundary phase are shielded by the Fe atom layer and hence the magnetocrystalline anisotropy is not lowered significantly.

Crystallographic Orientation in the Interface

Figure 3:
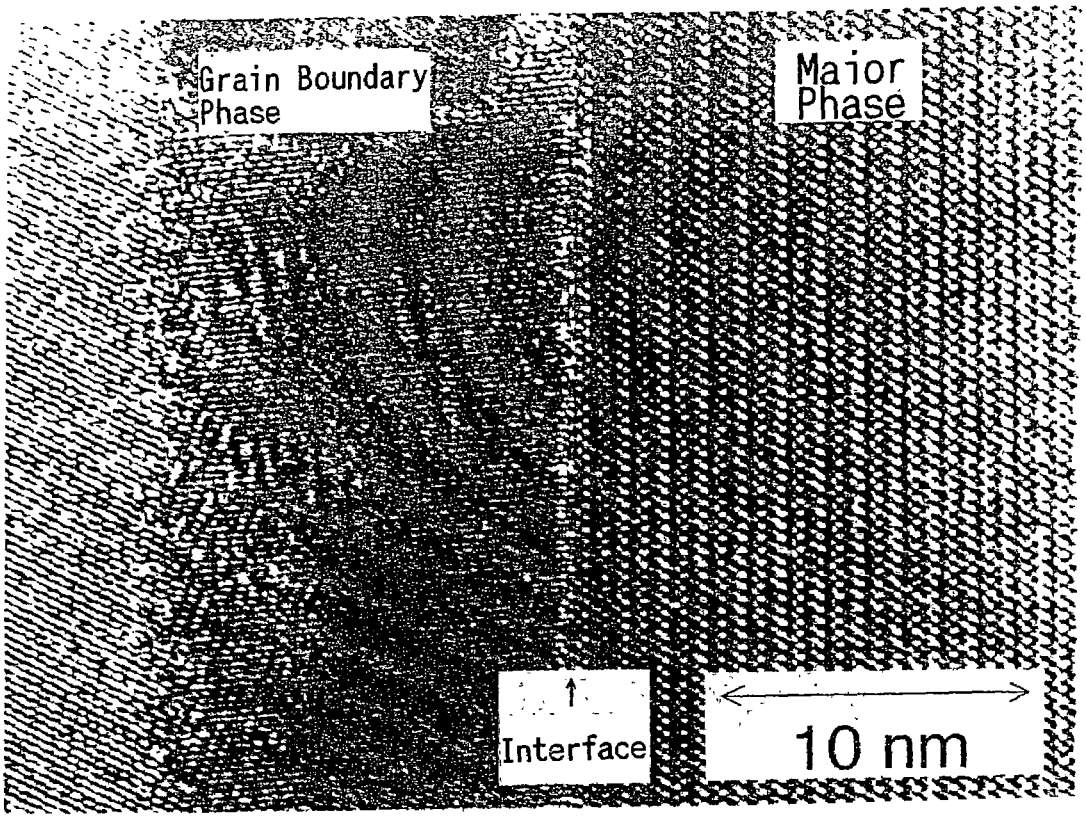
FIG. 3 is a photograph of electronic microscope of a permanent magnet (according to EX.6 of the present invention) in which the major phase is matched with the grain boundary phase.
Figure 4:
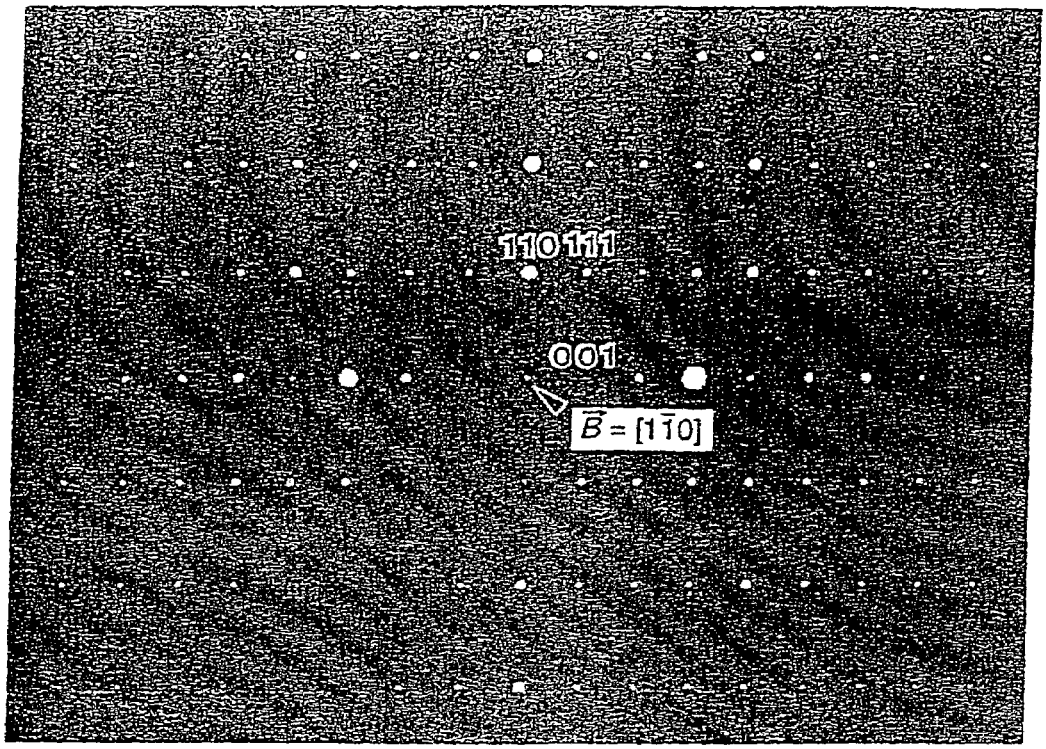
FIG. 4 is a photograph of electronic microscope showing an image of diffraction pattern of transmitted electron beam scattered from selected area on the major phase side shown in FIG. 3.
Figure 5:
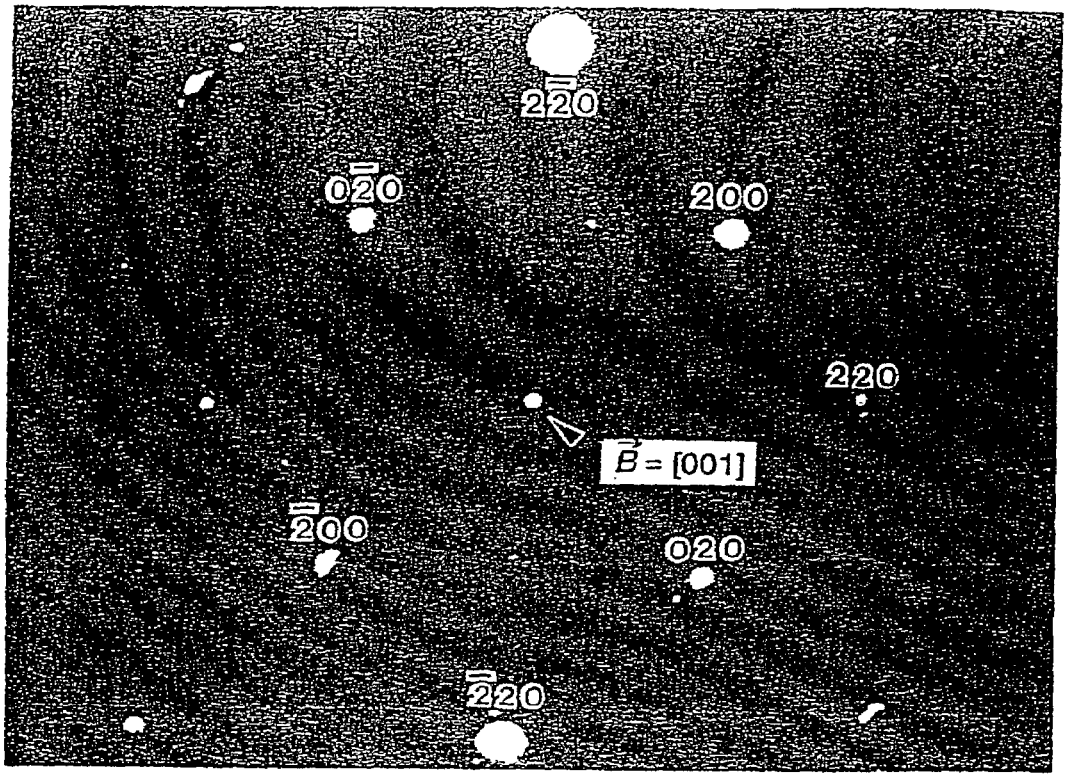
FIG. 5 is a photograph of electronic microscope showing an image of diffraction pattern of transmitted electron beam scattered from selected area on the grain boundary phase side shown in FIG. 3.

FIG. 3 is a microscopic photograph showing the $R_2TM_{14}B$ major phase (R: rare earth elements including Y; TM: Fe and/or Co) and the R-TM grain boundary phase matching with each other. FIG. 4 shows an image of diffraction pattern of transmitted electron beam scattered from selected area on the major phase shown in FIG. 3, while FIG. 5 shows an image of diffraction pattern of transmitted electron beam scattered from selected area on the grain boundary phase in FIG. 3. The results of analysis indicate that the crystallographic orientation of the two phases on the interface is represented by (001) major phase//(110) grain boundary phase and
[110] major phase//[001] grain boundary phase (1)

with a deviation in the orientation being within 5 form the parallel.

A sintered permanent magnet having this epitaxial interface has a coercivity significantly higher than that of a sintered magnet having a similar composition but which is mismatched with in its interface, such as, iHc=15.3 kOe and 7.2 kOe if the interface is matched or mismatched, respectively. It is desirable that not less than 50% of matching be realized in the interface between the major phase and the grain boundary phase.

Anisotropic Constant

In the permanent magnet of the present invention, the value of the anisotropic constant $K_1$ in the vicinity of the outermost shell of the ferromagnetic phase is desirably equivalent to or higher than that in the interior. By the term "equivalent" is meant a value at least to 50% of that in the interior. It is desirable that the magnetocrystalline anisotropy in the outermost shell of the ferromagnetic grains is stronger than that in the outermost shell of the ferromagnetic particles destitute of the grain boundary phase.

Distribution of Magnetocrystalline Anisotropy

Also, in permanent magnets having a specified crystal structure other than an amorphous structure and composed of crystal grains of at least one of metals, alloys or intermetallic compounds exhibiting ferromagnetic properties at room temperature, it is desirable that magnetocrystalline anisotropy at the outermost shell of the crystal grains be equivalent to or be improved over the interior (center) of crystal grains affected only to a negligible extent by the exterior side of the crystal grains, without being decreased significantly as compared to that in the interior. For realizing practical coercivity, the magnetocrystalline anisotropy at the outermost shell position of the crystal grains is desirably not less than one half that in the interior of the crystal grains affected only to a negligible extent by the exterior side of the crystal grains.

Surrounded Major Phase; Isolated Structure

The permanent magnet is desirably constituted by at least two phases, namely a major phase having a specified crystal structure other than an amorphous structure and composed of metals, alloys or intermetallic compounds exhibiting ferromagnetic properties at room temperature, and a grain boundary phase composed of metals, alloys or intermetallic compounds and which is present surrounding the major phase. The grain boundary phase surrounds part or all of the ferromagnetic phase (ferromagnetic grains or particles) making up the major phase to improve coercivity. It is desirable that not less than one-half of the ferromagnetic phase (ferromagnetic grains or particles) be surrounded by the grain boundary phase. It is also desirable that a given ferromagnetic grain and another ferromagnetic grain of the major phase be separated from each other. It is moreover desirable that a given ferromagnetic grain and another ferromagnetic grain of the major phase be partially or entirely isolated from each other by a substantially non-magnetic grain boundary phase.

Desirable Combination of Major Phase and Grain Boundary Phase

In the present invention, the metals, alloys or intermetallic compounds, desirable as the major phase, are desirably those having superior properties as the major phase of the permanent magnet, specifically, those having high saturation magnetization and a Curie temperature sufficiently higher than room temperature. Examples of the ferromagnetic materials satisfying the above conditions include Fe, Co, Ni, Fe—Co alloys, Fe—Ni alloys, Fe—Co—Ni alloys, Pt—Co alloys, Mn—Bi alloys, $SmCo_5$, $Sm_2Co_{17}$ $Ne_2Fe_{14}B$ and $Sm_2Fe_{17}N_3$. These ferromagnetic magnetic materials are merely illustrative and are not intended to limit the present invention.

In the present invention, the metals, alloys or intermetallic compounds, desirable as the grain boundary phase, are preferably those having a melting point or decomposition temperature higher than room temperature and lower than the melting point or the decomposition temperature of the major phase and which can readily be diffused around the major phase on heat treatment. The atoms making up the grain boundary phase are desirably those acting as cations for atoms of the outermost shell of the major phase to elevate magnetocrystalline anisotropy of the major phase. Examples of metals satisfying the above conditions include Be, Mg, Ca, Sr, Ba, all transition metal elements, including Zn and Cd, Al, Ga, In, Ti, Sn and Pb. The alloys or intermetallic compounds of the above metals can serve as the boundary phase. These are merely illustrative and are not intended to limit the scope of the present invention.

The combination of the major phase and the grain boundary phase is preferably such a combination in which the two phases co-exist in equilibrium at a certain temperature range, for example, the combination of the $SmCo_5$ major phase and the Y grain boundary phase. The major phase and a second phase may be reacted to produce a desirable third phase in the grain boundary, as in the case of the $Sm_2Fe_{17}N_3$ major phase and the Zn phase which are reacted to generate a phase of the intermetallic compound (T—FeZn). In the latter case, the third phase represents the grain boundary phase according to the present invention.

Range of Additive Trace Elements

It is desirable in the present invention to add trace amounts of mainly metal elements for improving the matching between the major phase and the grain boundary phase or magnetic properties. These small amounts of additive elements are present in partially located or concentrated state in the grain boundary to improve wetting of the interface, or are diffused into mismatching positions of the interface to adjust the lattice constant of the grain boundary phase to lower the interface energy to improve the matching performance of the interface, thereby improving the coercivity of the magnet.

As these additive elements, those capable of forming solid solution in the grain boundary phase, such as C, N, Al, Si, P, Ti, V, Cr, Mn, Fe, Co, Ni, Cu, Zn, Ga, Zr, Nb, Mo, and the above-mentioned metal elements, may be used. These are illustrative and are not meant to limit the scope of the invention. The above additive lements are added in an amount preferably from 0.05 to 1 wt % and more preferably from 0.1 to 0.5 wt % because not more than 1.0 wt % of the additive elements based on the total weight of the magnet is sufficient to give optimum residual flux density and not less than 0.05 wt % is sufficient to give pre-set effect. The additive trace elements may be contained from the outset in the mother alloy or posteriorly added by the powder metallurgical technique, depending on the manufacturing method of the magnet used. The additive trace elements may also be intruded into the major phase (ferromagnetic phase) or replace the elements making up the major phase.

Crystal Structure of the Magnetic Phase and Grain Boundary Phase

The crystal structure of the grain boundary phase is desirably similar to that of the magnetic phase. Moreover, the crystal structure of the grain boundary phase is desirably in a pre-set relative orientation with respect to the crystal structure of the magnetic phase. This improves a matching between specified atoms of the grain boundary phase and specified atoms of the major phase. For example, in permanent magnets made up of a major phase of $R_2TM_{14}B$ intermetallic compound (R: rare earth elements including Y, TM: Fe or Co)of the tetragonal system and a grain boundary phase of an R-TM alloy, the crystal structure of the grain boundary phase in the vicinity of the interface between the major phase and the grain boundary phase is preferably of the face-centered cubic structure. Also, as for the plane index and the azimuthal index, the crystallographic relative orientation in the vicinity of the interface between the major phase and the grain boundary phase is preferably as shown by the following formulas:

(001) major phase//(110) grain boundary phase and [110] major phase//[001] grain boundary phase (A)

(001) major phase//(221) grain boundary phase and [110] major phase//[111] grain boundary phase (B)

(001) major phase//(111) grain boundary phase and [100] major phase//[110] grain boundary phase (C)

A[0031]

Also, in permanent magnets made up of a major phase of $R_2TM_{14}B$ intermetallic compound (R: rare earth elements including Y, TM: Fe or Co)of the tetragonal system and a grain boundary phase of an $R_3TM$ alloy, the crystal structure of the grain boundary in the vicinity of the interface between the major phase and the grain boundary phase is preferably of the rhombic structure. Also, as for the plane index and the azimuthal index, the crystallographic relative orientation in the vicinity of the interface between the major phase and the grain boundary phase is preferably as shown by the following formulas:

(001) major phase//(001) grain boundary phase and [110] major phase//[110] grain boundary phase (F)

(001) major phase//(110) grain boundary phase and [110] major phase//[001] grain boundary phase (G)

(001) major phase//(221) grain boundary phase and [110] major phase//[111] grain boundary phase (H)

(001) major phase//(111) grain boundary phase and [100] major phase//[110] grain boundary phase (I)

It is sufficient if atoms (several atom layers at most) of the grain boundary phase in the vicinity of the interface to the major phase are matched with the major phase side and the grain boundary phase may be amorphous, partially amorphous or substantially amorphous. Although the desired effect may be achieved by the interface being partially matched, it is desirable that not less than one-half the interface be matched. Although the major phase and the grain boundary phase are desirably free of lattice defects in the vicinity of the interface, and kept continuous and regular, partial lattice defects are tolerated.

Also, in the major phase, so-called metalloids, such as C, Si or P, may be substituted for part or large part of B. For example, if C is substituted for B ($B_{1-x}C_x$, where x up to preferably 0.8 is allowed.

The R-TM-B alloys may be pulverized by any suitable known methods, such as casting pulverization method, quenching thin sheet pulverization method, rapid solidification method, direct reduction diffusion method, hydrogen absorption collapsing method or the atomizing method. If the mean particle size of the alloy powders is 1 μm or more, the powders are less liable to reaction with oxygen in atmosphere and to consequent oxidation, thus improving magnetic properties following the sintering. The mean particle size of 10 μm or less is desirable since the sintering density is raised. The mean particle size is preferably 1 to 6 μm.

The resulting alloy powders are fed to a metal mold and compression-molded under magnetic orientation in a magnetic field. As disclosed for example, in JP Patent Kokai JP-A-8-20801, it is desirable to add a binder to alloy powders to perform spray granulation for improving fluidity of the alloy powders to facilitate powder feed. Alternatively, as disclosed in JP Patent Kokai JP-A-6-77028, it is possible to add a binder to alloy powders to consolidate the green compact to an intricate shape by a metal injection molding method. If this binder is used, the binder contained in the green compact prior to sintering is preferably removed by thermal decomposition.

The produced green compact is sintered in vacuum or in an inert gas excluding nitrogen. Among the sintering conditions, which may be suitably selected depending on the composition or particle size of the R-TM-B alloy powders or the R-TM-B based alloy powders, the sintering temperature of 1000 to 1180° C. and the sintering time of 1 to 4 hours, for example, are preferred. The cooling rate following the sintering is critical in controlling the crystal structure of the grain boundary phase. That is, the grain boundary phase is a liquid phase at the sintering temperature, such that, if the cooling rate from the sintering temperature is too fast, the grain boundary phase contains many lattice defects or become amorphasized in an undesirable manner.

In the permanent magnet of the present invention, it suffices if the ferromagnetic phase exhibits practically useful coercivity under certain conditions, such that the permanent magnet may be constituted by one or more of metals, alloys, intermetallic compounds, metalloids or other compounds. The principle of the present invention may be applied to starting materials for permanent magnets, intermediate products, permanent magnets as ultimate products, and manufacturing methods thereof. The starting material for permanent magnets may be enumerated by powders prepared by a casting pulverizing method, a quenching thin plate pulverizing method, a rapid solidification method, a direct reducing method, a hydrogen absorption collapsing method or by an atomizing method. An intermediate product may be enumerated by a quenched thin plate, pulverized to a starting material for the powder metallurgical method, and a partially or totally amorphous material partially or entirely crystallized on thermal processing. The permanent magnet, as an ultimate product, may be enumerated by a magnet obtained on sintering or bonding the powders to a bulk form, a cast magnet, a rolled magnet and a thin-film magnet produced by the gas phase deposition method such as sputtering method, ion plating method, PVD method or the CVD method. The manufacturing method for a starting material for permanent magnets or permanent magnets as an ultimate product may be enumerated by a mechanical alloying method, a hot pressing method, a hot forming method, a hot or cold rolling method, a HDDR method, an extrusion method and a die upsetting method. These are merely illustrative and are not intended to limit the scope of the present invention. The permanent magnet according to the present invention is used for a motor, an MRI device for medical use or a speaker and so on.

A present embodiment of the present invention is explained taking an example of a sintering method (powder metallurgical method). In other known manufacturing methods for producing R-TM-B based permanent magnets a manner similar to the sintering method can be applied in connection with the specified method of realizing the desirable interface structure.

The sum of Nd and/or Pr in R equal to 50 at % or higher in the R-TM-B alloy or the R-TM-B based alloy as the starting material is desirable since the coercivity and residual magnetism of the produced magnet are thereby improved. It is also desirable to substitute Dy and/or Tb for a portion of Nd for improving coercivity. For TM, Fe and/or Co is particularly preferred. The content of Fe in TM of not less than 50 at % is preferred since the coercivity and residual magnetization of the produced magnet are thereby improved. Other addition elements than those specified above may be used for various purposes.

The preferred average composition of the permanent magnet embodying the present invention is such composition which permits co-existence of at least two phases of the $R_2TM_{14}B$ phase and the R-TM phase (containing not less than 90 at % of R). To this end, it suffices if the composition is such that R is 8 to 30 at % and B is 2 to 40 at %, with the balance mainly being TM. Preferably, the composition is 8 to 30 at % for R, 2 to 40 at % for B, 40 to 90 at % for Fe and 50 at % or less for Co. More preferably, the composition is 11 to 50 at % for R, 5 to 40 at % for Fe and the balance mainly being TM. Most preferably, the composition is 12 to 16 at % for R, 6.5 to 9 at % for B and the balance mainly being TM. By far the most preferably, the composition is 12 to 14 at % for R, 7 to 8 at % for B and the balance mainly being TM. The R-TM-B alloy used need not necessarily be made up of the sole required composition. Thus, alloys of different compositions may be pulverized and mixed and the resulting mixture may then be adjusted to a desired ultimate composition.

Embodiment of the Second and/or Forth Group Aspect of the Present Invention

Particularly, in the embodiment of the second and forth group aspect of the present invention, in order for the grain boundary phase to assume the face-centered cubic structure, the cooling rate from the sintering temperature is preferably in a range of 10 to 200° C./minute. By allowing the cooling to occur over an extended period of time, the regular crystal structure can be realized on cooling, without supercooling of the liquid grain boundary phase. If the grain boundary phase assumes the face-centered cubic structure, without being amorphous, the relative position of atoms in the interface between the major phase and the grain boundary phase becomes regular to maintain the matching therebetween, so that the possibility of the interface serving as a starting point of generation of the inverse magnetic domain (demagnetizing field) is decreased to realize high coercivity. The range of the cooling rate following the sintering which is more desirable is 20 to 100° C./min.

For achieving the effect of a interface matching, it is sufficient if several atomic layers at most in the vicinity of the interface between the major phase and the grain boundary phase assume the face-centered cubic structure. On the other hand, since the major phase is formed in general more promptly earlier than the grain boundary phase and the crystal grains making up the major phase are in the form of single crystal, therefore, if the major phase and the grain boundary phase are matched with each other, the magnetocrystalline anisotropy in the crystal grains is high ranging from the inner part to the outer shell to realize high coercivity.

The crystal grains of the respective major phases are preferably surrounded partially or entirely by the grain boundary phase(s). The crystal grain size of the major phase is preferably 10 nm to 500 μm. The more preferred range of the crystal grain size varies depending on different methods used, such as it is 10 to 30 μm for the sintering method and 20 to 100 nm for the rapid solidification method. If a grain boundary not accompanied by the grain boundary phase, twin-crystal grain boundary or precipitates are present in the major phase, the coercivity of the magnet is lowered. Therefore, the major phase is preferably single crystals.

The reason the specified relative crystallographic orientation in the interface improves the magnetic properties of a magnet is as follows: That is, in the vicinity of the interface of the major phase, the crystal field around the R atoms, governing the magnetocrystalline anisotropy of the major phase, is varied under the influence of the atomic arrangement of the neighboring grain boundary phase. If the crystallographic orientation of the R-TM grain boundary phase is related by (A) to (C) below relative to the major phase, the magnetocrystalline anisotropy in the vicinity of the interface of the major phase is raised because the relative position of the R atoms of the R-TM grain boundary phase and the R atoms in the major phase is such as to strengthen the anisotropy of the above-mentioned crystal field. The result is that generation of the inverse magnetic domain in the vicinity of the grain boundary is rendered difficult such that inversion of magnetization cannot occur easily thus improving the coercivity.

(001) major phase//(110) grain boundary phase and [110] major phase//[001] grain boundary phase (A)

(001) major phase//(221) grain boundary phase and [110] major phase//[111] grain boundary phase (B)

(001) major phase//(111) grain boundary phase and [100] major phase//[110] grain boundary phase (C)

In the above explanation, the atoms of the grain boundary phase affecting the crystal field of the R atoms in the major phase are limited only to those atoms in the vicinity of the interface neighboring to the major phase. Therefore, according to the present invention, it suffices if the relative orientation of the crystal structure of the above-mentioned major phase and the grain boundary phase holds only for a range of several atomic layers at most in the vicinity of the interface between the two phases.

As a method for realizing the above-mentioned relative crystallographic orientation, there is, for example, cooling rate control subsequent to sintering. If, for example, the cooling rate of 10 to 200° C./min is used for the temperature range from a temperature of approximately 800° C. or above that corresponds to the liquid phase of the R-TM grain boundary phase to a temperature of 300° C. or less that corresponds to the extremely retarded atomic dispersion, the grain boundary phase having a specified relative crystallographic orientation matched to the major phase can be precipitated in the vicinity of the interface with respect to the major phase. The preferred cooling rate is 20 to 100° C./min.

Since the ratio of the lattice constants of the major phase and the grain boundary phase differs depending on the difference in composition or the component element species of the major and grain boundary phases, there are occasions wherein a slight deviation is induced in the crystallographic orientation. However, since this angle of deviation is 5° at most, such deviation, even if produced, affects the crystal field of R atoms in the major phase only to a limited extent, thus manifesting the desired effect.

In addition to the control of the cooling rate from an elevated temperature, heat treatment of a magnet, once produced by the sintering method or the rapid solidification method, at a temperature range of 300 to 800° C., which is not higher than the melting point, and which facilitates atomic diffusion in the grain boundary phase, is similarly effective to control the interface structure. In this case, the energy of interface serves as the driving power to cause re-arraying of the grain boundary phase in the vicinity of the interface to the major phase, thus realizing a epitaxial interface. The desirable cooling rate after heat treatment is 10 to 200° C./min.

The present embodiment of the present invention has been explained in the foregoing mainly taking an example of the sintering method. However, other manufacturing methods for manufacturing R-TM-B based permanent magnets is similar to the sintering method insofar as the method of realizing the desirable interface structure is concerned.

If a bulk magnet, such as a sintered bulk magnet, is to be produced, the permanent magnet material with superior magnetic properties, produced by the above method, are surface-processed in a required manner, e.g., grinding, to give a required dimensional precision and magnetized for use as permanent magnets. After processing, heat treatment may be carried out for relaxing the effect of processing strain. If bonded magnets are to be produced, the resulting magnetic powders are mixed with resin and molded. If necessary, the molded mass may be surface-processed and magnetized for use as permanent magnets.

In the present invention, the metals, alloys or intermetallic compounds, desirable as the grain boundary phase, are preferably those having a melting point or decomposition temperature higher than room temperature and lower than the melting point or decomposition temperature of the major phase and those that can be diffused easily around the major phase by heat treatment. The atoms making up the grain boundary phase are preferably those which behave as cations with respect to the atoms of the outermost shell of the major phase to raise the magnetocrystalline anisotropy of the major phase. In particular, it is desirable that crystals containing cationic source are precipitated at least in the grain boundary phase portion neighboring to the ferromagnetic grains, and that, in the crystal structure of the grain boundary phase neighboring to the ferromagnetic phase (grain), cations are located in the extending direction of a 4f electron cloud of the rare earth element ions in the outermost shell of the ferromagnetic grain. The metals satisfying the above condition may be enumerated by one or more of Be, Mg, Ca, Sr, Ba, all transition metal elements (including Zn and Cd), Al, Ga, In, Tl, Sn and Pb, in addition to R in the R-TM, the $R_3TM$ and the R-TM-O compound. Alternatively, the above metals may be enumerated by one or more of Be, Mg, Al, Si, P, Ca, Sc, Ti, V, Cr, Mn, Fe, Co, Ni, Cu, Zn, Ga, Sr, Zr, Nb, Mo, Cd, In, Sn, Ba, Hf, Ta, Ir and Pb. Although alloys or intermetallic compounds of these metals may serve as the grain boundary phase, the examples are illustrative and are not intended to limit the scope of application of the present invention.

Crystal Structure of the magnetic Phase and Grain Boundary Phase

The crystal structure of the grain boundary phase is desirably similar to that of the magnetic phase. Moreover, the crystal structure of the grain boundary phase is desirably in a pre-set relative orientation with respect to the crystal structure of the magnetic phase. This improves matching between specified atoms of the grain boundary phase and specified atoms of the major phase. For example, in permanent magnets made up of a major phase of $R_2TM_{14}B$ intermetallic compound (R: rare earth elements including Y, TM: Fe or Co)of the tetragonal structure and a grain boundary phase of an R-TM alloy in particularly, the crystal structure of the grain boundary phase in the vicinity of the interface between the major phase and the grain boundary phase is preferably of the face-centered cubic structure. Also, as for the plane index and the azimuthal index, the crystallographic relative orientation in the vicinity of the interface between the major phase and the grain boundary phase is preferably as shown by the aforementioned formulas (A) to (C):

In permanent magnets made up of the major phase containing a tetragonal $R_2TM_{14}B$ intermetallic compound (R: rare earth element including Y; TM: Fe and/or Co) and the grain boundary phase containing a $R_3TM$ alloy, the crystal structure in the vicinity of the interface between the major and grain boundary phases is preferably of the rhombic system. Also, as to the direction vector and the plane index, the relative crystallographic orientation in the vicinity of the interface between the major and grain boundary phases is preferably any of the combinations (F) to (I):

(001) major phase//(001) grain boundary phase and [110] major phase//[110] grain boundary phase (F)

(001) major phase//(110) grain boundary phase and [110] major phase//[001] grain boundary phase (G)

(001) major phase//(221) grain boundary phase and [110] major phase//[111] grain boundary phase (H)

(001) major phase//(111) grain boundary phase and [100] major phase//[110] grain boundary phase (I)

If the grain boundary phase of an R-TM alloy and the grain boundary phase of an $R_3TM$ alloy co-exist, the relative crystallographic orientation the relative crystallographic orientation between these grain boundary phases and the major phase is preferably any of the combinations (A) to (C) or (F) to (I), respectively.

It suffices if atoms of the grain boundary phase in the vicinity of the interface to the major phase (several atomic layers at most) are matched with the major phase, such that the grain boundary phase may be amorphous, partially amorphous or predominantly amorphous. Although the meritorious effect is derived if part of the interface is in an epitaxial state, it is preferred that not less than half the interface be in the epitaxial state. It is also desirable that the major and grain boundary phases are free of lattice defects in the vicinity of the interface and kept in a continuous and regular state, although only partial lattice defects are allowable. In the interface, not less than 50% of the major and grain boundary phases are preferably in the epitaxial state.

Embodiment of the Third Group Aspect of the Present Invention

In the following the explanation proceeds by way of an example of the sintering method. However, the principle is applicable to other methods.

Particularly, in the embodiment of the third group aspect of the present invention, as a starting material, an R-TM-B alloy of a known composition, as disclosed in JP Patent Kokai JP-A-59-46008, may be used. If the sum of Nd and/or Pr in R is less than 50%, the produced magnet is lowered significantly in coercivity and residual magnetization. Therefore, the sum of Nd and/or Pr in R is preferably not less than 50 at %. For improving coercivity, Dy and/or Tb may be substituted for part of R. Fe in TM, which is Fe and/or Co, is preferably not less than 50 at % because the produced magnet is lowered significantly in coercivity and residual magnetism if Fe in TM is less than 50 at %. Also, Co in TM is preferably not less than 0.1 at % with a view to elevating the Curie temperature and improving the corrosion resistance. Other addition elements than those given above may also be added for various purposes.

A further desirable permanent magnet has a major phase composed of single crystals of an $R_2TM_{14}B$ intermetallic compound having a tetragonal crystal structure and an $R_3TM$ intermetallic compound having a rhombic crystal structure. It is noted that, in the $R_2TM_{14}B$ intermetallic compound, R is a rare earth element including Y, the sum of Nd and Pr in R is not less than 50 at %, TM is Fe and Co, with Fe and Co being not less than 50 at % and 0.1 at %, respectively, and that, in the $R_3TM$ intermetallic compound, having a rhombic crystal structure, Co in TM is not less than 90 at %.

It is preferred that the average composition of the desirable permanent magnet is such that at least two phases, that is $R_2TM_{14}B$ and $R_3TM$, with Co in TM of $R_3TM$ not being less than 90 at %, can co-exist. To this end, if suffices if the composition is such that R is 8 to 30 at % and B is 2 to 40 at %, with the balance being mainly TM. Preferably, composition is such that R is 8 to 30 at %, B is 2 to 40 at %, Fe is 40 to 90 at % and Co is not larger than 50 at %. More preferably, the composition is such that R is 11 to 50 at % and B is 5 to 40 at %, with the balance being mainly TM. Most preferably, the composition is such that R is 12 to 16 at % and B is 6.5 to 9 at %, with the balance being TM. By far the most preferably, the composition is such that R is 12 to 14 at % and B is 7 to 8 at %, with the balance being mainly TM. It is unnecessary for the R-TM-B alloy used to be of the sole composition. Thus, alloys of different compositions may be pulverized and mixed together and adjusted to a required composition.

In order for the grain boundary phase to assume the rhombic structure, the cooling rate from the sintering temperature is preferably in a range of 10 to 200° C./minute. By allowing the cooling to occur over an extended, sufficient period of time, the regular crystal structure can be realized on cooling, without supercooling of the liquid grain boundary phase. If the grain boundary phase assumes the rhombic structure, without being amorphous, the relative position of atoms in the interface between the major phase and the grain boundary phase is regular to maintain the matching therebetween, so that the possibility of the interface serving as a beginning point of generation of the inverse magnetic domain is decreased to realize high coercivity. The range of the cooling rate following the sintering which is more desirable is 20 to 100° C./minute.

For achieving the effect of interface matching, it is sufficient if several atomic layers at most in the vicinity of the interface between the major phase and the grain boundary phase assume the rhombic structure. On the other hand, since the major phase is formed in general more promptly earlier than the grain boundary phase and the crystal grains making up the major phase are single crystals, the major phase is matched with the grain boundary phase, so that the magnetocrystalline anisotropy in the crystal grains in a range from the inner part to the outer shell is high to realize high coercivity.

The ferromagnetic crystal grains of the respective major phases are preferably surrounded partially or entirely by the grain boundary phases. The crystal grain size of the major phase is preferably 10 nm to 500 μm. The more preferred range of the crystal grain size varies depending on different methods used, such that it is 10 to 30 μm for the sintering method and 20 to 100 nm for the rapid solidification method. If the grain boundary not accompanied by the grain boundary phase, twin-crystal grain boundary or precipitates are present in the major phase, the coercivity of the magnet is lowered. Therefore, the major phase is preferably single crystals.

The reason the specified relative crystallographic orientation in the interface improves the magnetic properties of a magnet is as follows: That is, in the vicinity of the interface of the major phase, the crystal field around the R atoms, governing the magnetocrystalline anisotropy of the major phase, is varied under the influence of the atomic arrangement of the neighboring grain boundary phase. If the crystallographic orientation of the $R_3TM$ grain boundary phase is related by (F) to (I) below relative to the major phase, the magnetocrystalline anisotropy in the vicinity of the interface of the major phase is raised because the relative position of the R atoms of the $R_3TM$ grain boundary phase and the R atoms in the major phase is such as to strengthen the above-mentioned magnetocrystalline anisotropy. The result is that generation of the inverse magnetic domain in the vicinity of the grain boundary is rendered difficult such that inversion of magnetization cannot occur easily thus improving the coercivity.

(001)major phase//(001)grain boundary phase and [110]major phase//[110]grain boundary phase (F)

(001)major phase//(110)grain boundary phase and [110]major phase//[001]grain boundary phase (G)

(001)major phase//(221)grain boundary phase and [110]major phase//[111]grain boundary phase (H)

(001)major phase//(111)grain boundary phase and [100]major phase//[110]grain boundary phase (I)

In the above explanation, the atoms of the grain boundary phase affecting the crystal field of the R atoms in the major phase are limited only to atoms in the vicinity of the interface neighboring to the major phase. Therefore, according to the present invention, it suffices if the relative orientation of the crystal structure of the above-mentioned major phase and the grain boundary phase holds only for a range of several atomic layers at most in the vicinity of the interface between the two phases.

As the method for realizing the grain boundary phase of the above-mentioned relative crystallographic orientation, there is, for example, cooling rate control subsequent to sintering. If, for example, the cooling rate of 10 to 200° C./minute is used for the temperature range from a temperature of approximately 800° C. or above corresponding to the liquid phase of the $R_3TM$ grain boundary phase to a temperature of 300° C. or less at which atomic dispersion is extremely retarded, the grain boundary phase having a specified relative crystallographic orientation to match with the major phase can be precipitated in the vicinity of the interface with respect to the major phase. The reason is that the grain boundary phase of the rhombic system grows to form an interface having the crystallographic orientation having the lowest surface energy on the surface of the major phase in the solid state. The preferred cooling rate is 20 to 100° C./minute.

Further processing conditions are like mentioned in the Second Group Aspect of the present invention by way of the sintering method.

A for the composition for the Third Group Aspect, the same applies as the case with the Second Group Aspect.

Embodiment of the Forth Group Aspect of the Present Invention

Particularly, in the embodiment of the forth group aspect of the present invention, the preferred average composition of the permanent magnet embodying the present invention is such composition which permits co-existence of at least two phases of the $R_2TM_{14}B$ phase and the R-TM phase containing not less than 90 at % of R. To this end, it suffices if the composition is such that R is 8 to 30 at % and B is 2 to 40 at %, with the balance being TM. Preferably, the composition is 8 to 30 at % for R, 2 to 40 at % for B, 40 to 90 at % for Fe and 50 at % or less for Co. More preferably, the composition is 11 to 50 at % for R, 5 to 40 at % for Fe and the balance being TM. Most preferably, the composition is 12 to 16 at % for R, 6.5 to 9 at % for B and the balance mainly being TM. By far the most preferably, the composition is 12 to 14 at % for R, 7 to 8 at % for B and the balance being TM. The starting materials used need not necessarily be of the sole required composition. Thus, alloys of different compositions may be pulverized and mixed and the resulting mixture may then be adjusted to a desired ultimate composition.

In the present specification, the statement on upper or lower limits of numerical values include not only the upper or lower limit values but also any optional intermediate values in-between.

The oxygen may be added to Fe or R alloys used as starting materials, for example, to a production process, such as a pulverization step. Industrially, oxygen inevitably contained in the starting material may be used as an oxygen source of an R-TM-O compound. Alternatively, oxygen may be captured into the production process, specifically, to a starting alloy material or an intermediate alloy product. Still alternatively, the captured oxygen may be used as an oxygen source for an R-TM-O compound.

In order for the grain boundary phase to assume the face-centered cubic structure, the cooling rate from the sintering temperature is preferably comprised in a range of 10 to 200° C./minute. By allowing the cooling to occur over an extended period of time, the regular crystal structure can be realized on cooling, without supercooling of the liquid grain boundary phase. If the grain boundary phase assumes the face-centered cubic structure, without being amorphous, the relative position of atoms in the interface between the major phase and the grain boundary phase is regular to maintain the matching therebetween, so that the possibility of the interface serving as a starting point of generation of the inverse magnetic domain is decreased to realize high coercivity. The range of the cooling rate following the sintering which is more desirable is 20 to 100° C./min.

In order for the grain boundary phase to assume the face-centered cubic structure, oxygen is preferably contained in the grain boundary phase as a compound component. For example, oxygen can be introduced into the magnet in the course of a process of pulverizing, consolidating and sintering the R-TM-B based alloy of the above composition. This oxygen is introduced as a solid solution in the grain boundary phase to form a component in the R-TM-O compound to stabilize the face-centered cubic structure of the grain boundary phase. The ratio of R to the sum of R and TM in the R-TM-O compound of the grain boundary phase, thus formed, is preferably not less than 90 at %.

The ratio of O in the R-TM-O compound of the grain boundary phase of not less than 1 at % is highly efficient in stabilizing the face-centered cubic structure at not less than 1 at %, cam form an ideal interface for improving the coercivity, while being highly effective to elevate the magnetocrystalline anisotropy in the vicinity of the interface of the $R_2TM_{14}B$ tetragonal phase by the grain boundary phase. On the other hand, the ratio of O not larger than 70 at % is also desirable in having a significant effect in increasing the magnetocrystalline anisotropy in the vicinity of the $R_2TM_{14}B$ tetragonal crystal phase by the grain boundary phase to improve the coercivity. Therefore, the ratio of O in the R-TM-O compound of the grain boundary phase is preferably not less than 1 at % and not larger than 70 at %. That is, an R-TM-O compound of an indefinite ratio in the O composition of a certain width in the vicinity of the interface is preferably present in the vicinity of the interface. Preferably, the composition for O is 2 to 50 at % and more preferably 4 to 15 at % or 5 to 15 at %.

The reason the specified relative crystallographic orientation in the interface improves the magnetic properties of a magnet is as follows: That is, in the vicinity of the interface of the major phase, the crystal field around the R atoms, governing the magnetocrystalline anisotropy of the major phase, is varied under the influence of the atomic arrangement of the neighboring grain boundary phase. If the crystallographic orientation of the R-TM grain boundary phase is related by (A) to (C) below relative to the major phase, the magnetocrystalline anisotropy in the vicinity of the interface of the major phase is raised because the relative position of the R atoms of the R-TM grain boundary phase and the R atoms in the major phase is such as to strengthen the anisotropy of the above-mentioned crystal field. The result is that generation of the inverse magnetic domain in the vicinity of the grain boundary is rendered difficult such that inversion of magnetization cannot occur easily thus improving the coercivity.

(001) major phase//(110) grain boundary phase and [110] major phase//[001] grain boundary phase (A)

(001) major phase//(221) grain boundary phase and [110] major phase//[111] grain boundary phase (B)

(001) major phase//(111) grain boundary phase and [100] major phase//[110] grain boundary phase (C)

In the above explanation, the atoms of the grain boundary phase affecting the crystal field of the R atoms in the major phase are limited only to atoms in the vicinity of the interface neighboring to the major phase. Therefore, according to the present invention, it suffices if the relative orientation of the crystal structure of the above-mentioned major phase and the grain boundary phase holds only for a range of several atomic layers at most in the vicinity of the interface between the two phases.

As the method for realizing the above-mentioned relative crystallographic orientation, there is, for example, cooling rate control following sintering. If, for example, the cooling rate of 10 to 200° C./min is used for the temperature range from a temperature of approximately 800° C. or above corresponding to the liquid phase of the R-TM-O grain boundary phase to a temperature of 300° C. or less at which the extremely retarded atomic dispersion prevails, the grain boundary phase having a specified relative crystallographic orientation matched to the major phase can be precipitated in the vicinity of the interface with respect to the major phase. The preferred cooling rate is 20 to 100° C./min.

Since the ratio of the lattice constants of the major phase and the grain boundary phase differs depending on the difference in composition or the component element species of the major and grain boundary phases, there are occasions wherein a slight deviation is induced in the crystallographic orientation. However, since this angle of deviation is 5° at most, such deviation, if produced, affects the crystal field of R atoms in the major phase only to a limited extent, thus manifesting the desired effect.

In addition to control of the cooling rate from elevated temperature, heat treatment of a magnet, once produced by the sintering method or the rapid solidification method, at a temperature range of 300 to 800° C., which is lower than the melting point, and which facilitates atomic diffusion in the grain boundary phase, is similarly effective to control the interface structure. In this case, the energy of the interface serves as the driving power to cause re-arraying of the grain boundary phase in the vicinity of the interface to the major phase, thus realizing a epitaxial interface. The desirable cooling rate after heat treatment is 10 to 200° C./min.

The present embodiment of the present invention has been explained in the foregoing mainly taking an example of the sintering method. However, other manufacturing methods for manufacturing R-TM-B based permanent magnets is similar to the sintering method insofar as the method of realizing the desirable interface structure is concerned.

If a bulk magnet, such as a sintered bulk magnet, is to be produced, the permanent magnet material with superior magnetic properties, produced by the above method, are surface-processed in a required manner and magnetized for use as permanent magnets. After processing, heat treatment may be carried out for relaxing the effect of processing distortions. If bonded magnets are to be produced, the resulting magnetic powders are mixed with resin and molded. If necessary, the molded mass may be surface-processed and magnetized for use as permanent magnets.

Other procedural features and conditions are similarly applicable as the case with the Second Group Aspects.

Crystal Structure of the magnetic Phase and Grain Boundary Phase

The crystal structure of the grain boundary phase is desirably similar to that of the magnetic phase. Moreover, the crystal structure of the grain boundary phase is desirably in a pre-set relative orientation with respect to the crystal structure of the magnetic phase. This improves a matching between specified atoms of the grain boundary phase and specified atoms of the major phase. For example, in permanent magnets made up of a major phase of $R_2TM_{14}B$ intermetallic compound (R: rare earth elements including Y, TM: Fe or Co)of the tetragonal structure and a grain boundary phase of an R-TM-O compound in particularly, the crystal structure of the grain boundary phase in the vicinity of the interface between the major phase and the grain boundary phase is preferably of the face-centered cubic structure. Also, as for the plane index and the azimuthal index, the crystallographic relative orientation in the vicinity of the interface between the major phase and the grain boundary phase is preferably as shown by the following formulas (A) to (C):

In permanent magnets made up of the major phase containing a tetragonal $R_2TM_{14}B$ intermetallic compound (R: rare earth element including Y; TM: Fe and/or Co) and the grain boundary phase containing a $R_3TM$ alloy, the crystal structure in the vicinity of the interface between the major and grain boundary phases is preferably of the rhombic system. Also, as to the direction vector and the plane index, the relative crystallographic orientation in the vicinity of the interface between the major and grain boundary phases is preferably any of the combinations (F) to (I):

(001) major phase//(001) grain boundary phase and [110] major phase//[110] grain boundary phase (F)

(001) major phase//(110) grain boundary phase and [110] major phase//[001] grain boundary phase (G)

(001) major phase//(221) grain boundary phase and [110] major phase//[111] grain boundary phase (H)

(001) major phase//(111) grain boundary phase and [100] major phase//[110] grain boundary phase (I)

If the grain boundary phase of an R-TM-O compound and the grain boundary phase of an $R_3TM$ compound co-exist, the relative crystallographic orientation between these grain boundary phases and the major phase is preferably any of the combinations (A) to (C) or (F) to (I), respectively.

Meanwhile, an R-TM compound, having a crystal structure similar to that of the R-TM-O compound, that is an R-TM-O compound less O, may co-exist as a grain boundary phase. The crystallographic relative orientation of the grain boundary phase and the major phase may be any of the combinations (A) to (C). In particular, the ratio of R to the sum of R and TM in the R-TM compound is preferably not less than 90 at %.

It is retained to be experimentally possible to remove oxygen contained inevitably in the starting material substantially completely and to reduce mixing of oxygen in the manufacturing process to substantially zero. However, such is extremely difficult on the industrial scale. Therefore, it is desirable that, industrially, the R-TM-O compound containing oxygen and the major phase are matched with each other.

Embodiment of the Fifth Group Aspect of the Present Invention

Particularly, in a present embodiment of the rare earth element magnetic powders for bonded magnets according to the Fifth Group Aspect of the present invention, alkaline earth metals, such as Ca metals, are present matched with $R_2TM_{14}B$ crystals on an interface with and $R_2TM_{14}B$ where R is a rare earth element including Y and TM is a transition metal. For a case in which the alkaline earth metal is Ca, the reason the coercivity of the powders is displayed is explained.

In an $R_2TM_{14}B$ based magnetic powders, in which Ca metals are diffused in a $R_2TM_{14}B$ crystal grain boundary, it may be premeditated that Ca in the grain boundary most neighboring to the $R_2TM_{14}B$ crystal grains are arranged in an ionized state to produce a crystal field in the c-axis direction at the outermost TM position of the $R_2TM_{14}B$ crystal grains. By this specified arrangement, the outermost contacting TM of the $R_2TM_{14}B$ crystal grains feels the crystal field in the c-axis direction, as a result of which the inverse magnetic domain from the TM site is prohibited to demonstrate the coercivity.

Representative among R is Nd. Meanwhile, in a $Nd_2TM_{14}B$ based sintered magnet, Nd present around the $Nd_2TM_{14}B$ crystal grains is of a face-centered cubic (fcc) structure, with its lattice constant being 5.2 A(Angstrom). The impregnating metal in the present invention preferably has a crystal structure similar to that of the Nd and a lattice constant close to that of the Nd. These preferred metals may be enumerated by metals, such as Ca (fee, a=5.582A), alloys of different alkaline earth metals or alloys of alkaline earth metals with metals of other groups, such as Ca—Al, and compounds thereof, such as $CaF_2$, CaO—SrO or BaO. For example, Sr (a=6.085 A) may be alloyed with Ba (a=5.025 A) at a pre-set ratio to give a desirable crystal structure and a desirable lattice constant. The alkaline earth metals may be enumerated by metals, such as Ca, alloys such as Sr— Ba, and compounds thereof, such as $CaF_2$ or CaO.

In this manner, it is preferred that the phase matching with the $R_2TM_{14}B$ phase on an interface to the $R_2TM_{14}B$ phase assumes a cubic system and is present with a lattice constant ranging between 4.7 and 5.7 A(Angstrom). The same applies for bonded magnets or a sintered magnet of the $R_2TM_{14}B$ system in a bulk magnet configuration.

In a present embodiment of the rare earth element magnetic powders for bonded magnets according to the present invention, the alkaline earth metals assume a cubic system structure in an interface to the $R_2TM_{14}B$ phase, with the lattice constant ranging between a=4.7 to 5.7 A(Angstrom). The alkaline earth metals are present in the powders preferably alone, alloys between different alkaline earth metals, alloys with other metals, compounds or mixtures thereof.

For achieving the effect of the interface matching, it suffices if the crystal structure of alkaline earth metals, such as Ca metal, referred to hereinafter as the grain boundary phase, are in the cubic crystal system within an extent of several atom layers at most in the vicinity of the interface of the $R_2TM_{14}B$ phase, referred to hereinafter as the major phase. The cubic crystal structure may be enumerated by face-centered cubic structure, fluorite structure or the NaCl type structure. In particular, the face-centered cubic structure similar to the Nd crystal structure is preferred. The major phase is generally formed more promptly than the grain boundary phase, and the crystal grains making up the major phase are single crystals, and hence the major phase is matched with the grain boundary phase, so that the magnetocrystalline anisotropy in the crystal grain becomes higher in the range from the inner part to the outer shell of the crystal grain, thus realizing high coercivity.

The reason the specified relative crystallographic orientation in the interface improves the magnetic properties of a magnet is as follows: In the vicinity of the interface of the major phase, the crystal field around the R atoms, governing the magnetocrystalline anisotropy of the major phase, is varied under the effect of the atomic arrangement of the neighboring grain boundary phase. If the crystallographic orientation of the Ca metal grain boundary phase is related by (A) to (E) below relative to the major phase, the magnetocrystalline anisotropy in the vicinity of the interface of the major phase is raised because the relative position of the Ca metals in the grain boundary phase and the R atoms in the major phase is such as to strengthen the anisotropy of the above-mentioned crystal field. The result is that generation of the reverse magnetic domain in the vicinity of the grain boundary is rendered difficult such that inversion of magnetization cannot occur easily thus improving the coercivity.

(001)major phase//(110)grain boundary phase and [110]major phase//[001]grain boundary phase (A)

(001)major phase//(221)grain boundary phase and [110]major phase//[111]grain boundary phase (B)

(001)major phase//(111)grain boundary phase and [110]major phase//[110]grain boundary phase (C)

(001)major phase//(201)grain boundary phase and [110]major phase//[010]grain boundary phase (D)

(001)major phase//(223)grain boundary phase and [110]major phase//[110]grain boundary phase (E)

In the above explanation, the atoms of the grain boundary phase influencing the crystal field of the R atoms in the major phase are those lying in the vicinity of the interface neighbouring to the major phase. Therefore, according to the present invention, it suffices if the relative orientation of the crystal structure of the grain boundary phase and the grain boundary phase holds only for a range of several atomic layers at most in the vicinity of the interface between the two phases.

Since the ratio of the lattice constants of the major phase and the grain boundary phase differs depending on the difference in composition or the component element species of the major and grain boundary phases, there are occasions wherein a slight deviation is induced in the crystallographic orientation. However, since this angle of deviation is 5° C. at most, such deviation, if produced, affects the crystal field of R atoms in the major phase only to a limited extent, thus manifesting the desired effect.

In the present invention, the metals, alloys or intermetallic compounds, desirable as the grain boundary phase, are preferably those having a melting point or decomposition temperature higher than room temperature and lower than the melting point or decomposition temperature of the major phase and those that can be diffused easily around the major phase by heat treatment. The atoms making up the grain boundary phase preferably behave as cations with respect to the atoms of the outermost shell of the major phase to raise the magnetocrystalline anisotropy of the major phase. In particular, it is desirable that crystals containing cationic source are precipitated at least in the grain boundary phase portion neighboring to the ferromagnetic particles, and that, in the crystal structure of the grain boundary phase neighboring to the ferromagnetic phase, cations are located in the extending direction of a 4f electron cloud of the rare earth element ions in the outermost shell of the ferromagnetic particles. The metals satisfying the above condition may be enumerated by one or more of Be, Mg, Ca, Sr, Ba, all transition metal elements (including Zn and Cd), Al, Ga, In, Tl, Sn and Pb, as enumerated including alkaline earth metal elements. Alternatively, the above metals may be enumerated by one or more of Be, Mg, Al, Si, P, Ca, Sc, Ti, V, Cr, Mn, Fe, Co, Ni, Cu, Zn, Ga, Sr, Zr, Nb, Me, Cd, In, Sn, Ba, Hf, Ta, Ir and Pb. Although alloys or intermetallic compounds or compounds of these metals may serve as the grain boundary phase, the examples are illustrative and are not intended to limit the scope of application of the present invention.

In a present embodiment of the rare earth element magnetic powders for bonded magnets, Ca is impregnated in a particle containing a single $R_2TM_{14}B$ crystal, and at least a portion and preferably the entire portion of the rim of the $R_2TM_{14}B$ crystal is covered with a Ca-containing grain boundary phase.

Figure 6:
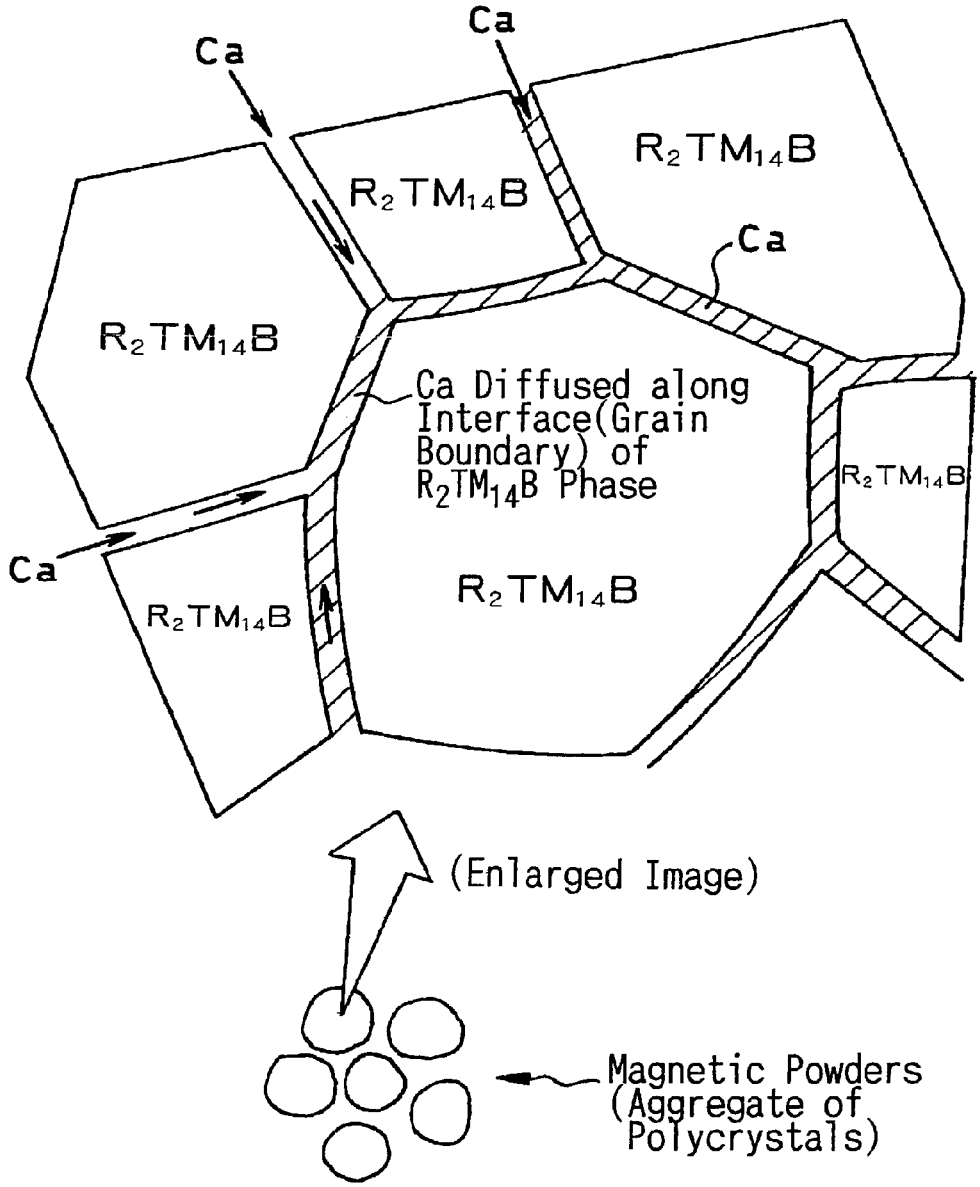
FIG. 6 illustrates a crystal structure of magnetic powders of a rare earth element for bonded magnets or polycrystalline grains of $R_2TM_{14}$ B according to an embodiment of the present invention.

Alternatively, Ca is impregnated in a particle (or particles) each containing plural $R_2TM_{14}B$ crystals ($R_2TM_{14}B$ polycrystalline grains), and at least a portion and preferably the entire portion of the rim of each $R_2TM_{14}B$ crystal is covered with a Ca-containing grain boundary phase. FIG. 6 illustrates a crystal structure of the polycrystalline powders, that is the latter case.

The powders of the $R_2TM_{14}B$ crystals, having the interface sufficiently covered to assure improved coercivity may be obtained by impregnation with the above-mentioned alkaline earth metals an amount preferably of 0.5 to 7 parts by weight and more preferably 1 to 7 parts by weight to 100 parts by weight of the magnetic powders containing the $R_2TM_{14}B$ phase, where R is rare earth element including Y and TM is transition metal.

According to the present invention, the rare earth element magnetic powders for bonded magnets having coercivity iHc not less than 17 kOe and further not less than 20 kOe can be obtained by impregnating alkaline earth metals into powders mainly composed of magnetic particles containing the $R_2TM_{14}B$ phase, where R is rare earth element including Y and TM is transition metal.

In the rare earth element magnetic powders for bonded magnets according to the present invention, there may be contained a B-rich phase or an R-rich phase in addition to the $R_2TM_{14}B$ phase, where R is rare earth element including Y and TM is transition metal. It is also possible for the R-TM-O phase and the $R_3TM$ phase to co-exist. In particular, it is desirable for the R-TM-O phase to co-exist with the $R_2Fe_{14}B$ phase in a matched state. If there exists the R—(Fe, Co)—B phase, it is desirable for the $R_3$-TM phase to co-exist with the R—(Fe, Co)—B phase in the epitaxial state.

The manufacturing method for the rare earth element magnetic powders for bonded magnets according to the present invention includes, in its preferred embodiment, the following steps:

(1) The step of melting an ingot from a starting material of a pre-set composition;

(2) pulverizing the ingot to produce powders of the starting material (powders prior to impregnation); and (3) impregnating alkaline earth metals, such as Ca, in the powders (2) to obtain powders containing the $R_2TM_{14}B$ phase and alkaline earth metals in a epitaxial state to each other.

Further, using the powders (3), bonded magnets can be produced by the following steps:

(4) adding a bond and an aiding agent to the powders and kneading the resulting mass;

(5) press-molding a kneaded article;

(6) heating and hardening the molded article; and (7) coating the surface of the hardened article.

According to the present invention, magnetic powders of high coercivity (powders prior to impregnation) can be obtained even with the use of powders obtained on pulverizing an ingot from a low-cost casting method (powders of cast ingots). In addition, one or two or more of powders obtained by known methods, such as powders obtained on pulverizing a thin sheet by a molten metal quenching method, rapid solidfication method, direct reduction diffusion method, hydrogenation-decomposition-dehydrogenation-recombination method (HDDR method) or the atomizing method may be used as powders of the starting material.

The composition of a preferred starting material (starting powders or mother alloys or composition of the starting material of the mother alloy) is hereinafter explained.

The sum of Nd and/or Pr in R equal to 50 at % or higher in the R-TM-B alloy as the starting material is desirable since the coercivity and residual magnetism of the produced magnet are thereby improved. It is also desirable to substitute Dy and/or Tb for a portion of Nd for improving coercivity. For TM, Fe and/or Co is particularly preferred. The content of Fe in TM of not less than 50 at % is preferred since the coercivity and residual magnetism of the produced magnet are thereby improved. Other addition elements than those specified above may be used for various purposes.

The preferred composition of R,TM AND B which are component elements of a $R_2TM_{14}B$ is hereinafter explained.

The preferred average composition of the permanent magnet embodying the present invention is such composition which permits co-existence of at least two phases of the $R_2TM_{14}B$ phase and the R-TM phase containing not less than 90 at % of R. Preferably, the composition is such that R is 8 to 30 at % and B is 2 to 40 at %, with the balance mainly being TM. Preferably, the composition is 8 to 30 at % for R, 2 to 40 at % for B, 40 to 90 at % for Fe and 50 at % or less for Co. More preferably, the composition is 11 to 50 at % for R, 5 to 40 at % for B and the balance mainly being TM. Most preferably, the composition is 12 to 16 at % for R, 6.5 to 9 at % for B and the balance mainly being TM. By far the most preferably, the composition is 12 to 14 at % for R, 7 to 8 at % for B and the balance mainly being TM. The starting materials used need not necessarily be of the sole required composition. Thus, alloys of different compositions may be pulverized and mixed and the resulting mixture may then be adjusted to a desired ultimate composition.

Also, in the major phase, so-called metalloids, such as C, Si or P, may be substituted for part or large part of B. For example, if C is substituted for B ($B_{1-x}C_x$, where x up to preferably 0.8 is allowed.

The desirable amount of impregnation of alkaline earth metals, such as Ca metals, to the starting powders (powders prior to impregnation) is now explained. 0.5 to 7 and preferably 1 to 5 parts by weight of alkaline earth metals are desirably impregnated to 100 parts by weight of R-TM-B where R is a rare earth element including Y, with $0<x\leqq 0.3$, and TM is a transition metal. In this embodiment, high coercivity can be achieved by addition of inexpensive alkaline earth metals, even though the expensive rare earth elements are used in a limited quantity.

For impregnating alkaline earth metals, such as Ca metals, powders of alkaline earth metals, mainly composed of magnetic particles containing an $R_2TM_{14}B$ phase, where R is a rare earth element including Y and TM is a transition metal, are added and mixed together. The resulting mixture is heat-treated at a temperature not higher than the melting point of $R_2TM_{14}B$ to diffuse alkaline earth metals along the interface of the $R_2TM_{14}B$ phase.

In the above embodiment, it is desirable that the mean particle size of powders mainly composed of magnetic particles be 3 to 400 μm, the mean particle size of the powders of alkaline earth metals be 0.5 to 3 mm and preferably 1 to 3 mm. This matches the interface of the $R_2TM_{14}B$ phase over a sufficient area with the alkaline earth metals.

As an alternative method for impregnating the powders of rare earth elements with alkaline earth metals, such as Ca, from the particle surface are that the alkaline earth metals, such as Ca, are first deposited on the surface of the magnetic particles by a gaseous phase film forming method, such as vacuum deposition, sputtering, ion plating, CVD or PVD, and subsequently, the resulting magnetic particles are heat-treated in an inert gas atmosphere or in vacuum to diffuse and permeate Ca along the grain boundary as far as the inside of the magnetic powders, at the same time as Ca is matched with, that is completely bonded to, the magnetic atoms even on the powder surface.

The preferred heat treatment temperature is such a temperature at which the $R_2Fe_{14}B$ phase is not dissolved and at which the Ca metal is diffused sufficiently, that is dissolved or evaporated. If R=Nd, this temperature is lower than 1200° C. That is, since the melting temperature of Ca metals is 851° C., the heat treatment temperature is preferably 600 to 800° C.

In order for the Ca metal to assume the face-centered cubic structure on the interface to the $R_2Fe_{14}B$ phase, the cooling rate following heat treatment is preferably 10 to 200° C./min. If the cooling is allowed to occur over a sufficiently long period, the grain boundary phase in the liquid phase state containing the Ca metal can assume a regular crystal structure at the time of cooling without supercooling of the liquid grain boundary phase. By the grain boundary phase assuming the face-centered cubic structure without assuming the amorphous state, the relative position of the atoms in the interface between the major phase and the grain boundary phase is regular to maintain the matching therebetween, as a result of which the risk of the interface serving as the originating point of the reverse magnetic domain is diminished to realize high coercivity. The more desirable range of the cooling rate after sintering is 20 to 100° C./minute.

Since alkaline earth metals, such as Ca, are highly susceptible to oxidation, it is preferred that the magnetic powders impregnated with the metals be coated with resin, plated or coated with TiN by way of rust-proofing.

Since the alkaline earth metals, such as Ca, are relatively low in melting point (851° C.), a bond is preferably used for processing the rare earth element magnetic powders impregnated the alkaline earth metals according to the present invention to a bulk form.

Bonded magnets can be molded by any suitable processes, compression molding, extrusion molding, injection molding, roll molding and the other known processes. The bond used may be of a variety of materials, such as epoxy resin, nylon resin or rubber.

The produced bonded magnets may be surface-processed by rinsing, chamfering, electrolytic plating, non-electrolytic plating, electro-deposition coating or resin coating, and subsequently magnetized for use as permanent magnets.

The magnetic powders of the rare earth element according to the present invention may be fed to a metal mold for compression consolidating under magnetic orientation in a magnetic field. In this case, a binder may be added to the alloy powders for spray granulation for improving fluidity of alloy powders to facilitate the feeding of the powders, as disclosed in, for example, JP Patent Kokai JP-A-8-20801. Alternatively, a binder may be added to the alloy powders to mold an article of an intricate shape by a metal injection molding method as disclosed in JP Patent Kokai JP-A-6-77028.

The inventive technique of impregnating powders mainly composed of $R_2TM_{14}B$ based magnetic particles with Ca metals, and so on, can also be used as means for improving coercivity of the $R_2TM_{14}B$ thin-film magnet. For example, alkaline earth metals, such as Ca, may be deposited on the $R_2TM_{14}B$ thin-film magnet, produced by the vacuum deposition or sputtering method, for further improving magnetic properties.

It should be noted that the numerical values denote not only upper and lower limit values but also any optional intermediate values between the limit values.

EXAMPLES

Example 1

$Nd_2Fe_{14}B$ crystal grains, with a grain size of 10 μm, were press-consolidated under orientation in a magnetic field. 5 wt % of Ca metal powders, pulverized to not more than 200 μm, were sprinkled over the surface of the green compact, heated in vacuum at 800° C. for one hour and cooled. The resulting sample was of such a structure in which crystal grains of $Nd_2Fe_{14}B$ as the major phase are surrounded by the grain boundary phase of Ca metal, with the two phases being directly contacted with each other with a epitaxial interface in-between. The sample has a coercivity of 1.3 MA/m.

Comparative Example 1

The green compact from Example A1 was as such heated in vacuum at 1060° C. for one hour and cooled. The $Nd_2Fe_{14}B$ sample crystal grains produced contained many voids, while forming sintered necks in the contact points, with an oxide phase being present on the surface of the crystal grains of the voids. The sample had a coercivity of 0.1 MA/m.

Example 2

On the surface of $Sm_2Fe_{17}N_x$, where x is approximately 3, having a grain diameter of 10 μm, Zn was coated in an amount of 2 wt % by an electroless plating method. The resulting mass was heated in vacuum at 450° C. for one hour and cooled. The resulting sample was of a structure in which $Sm_2Fe_{17}N_x$ crystal grains as the major phase were surrounded by a Zn metal phase, with the two phases being directly contacted with each other with an epitaxial interface. The sample had a coercivity of 1.9MA/m.

Comparative Example 2

The sample obtained on Zn plating by Example 2 showed a disturbed crystal state of the interface between the major phase and the Zn metal phase, and lacked in the matching of the interface. The sample had a coercivity of 0.3 MA/m.

Example 3

On the surface of a thin $SmCo_5$ film of 80 μm thick, prepared by the sputtering method, as a substrate was heated to 700° C., Y was coated to a thickness of 5 μm by the sputtering method, as the substrate was heated to 400° C. By X-ray diffraction, the crystal structure of $SmCo_5$ in the sample film obtained had a hexagonal $CaCu_5$ structure, while Y had a La type structure of the hexagonal close-packed structure, with the two having a crystal azimuth such that its c-axis is perpendicular to the film surface. Observation of the structure of the sample cross-section over a transmission electronic microscope revealed that the $SmCo_5$ phase was formed in a columnar crystal state of several μm in diameter, with an epitaxial interface between the $SmCo_5$ phase and the Y phase. The thin film had a coercivity of 1.5 MA/m.

Comparative Example 3

On the surface of a $SmCo_5$ thin film, 80 mm thick, obtained in Example 3, Y was coated by sputtering to a thickness of 5 μm, without heating a substrate. The crystal structure of $SmCo_5$ in the sample film obtained had a hexagonal $CaCu_5$ crystal structure, while that of Y was of the La type structure which is the hexagonal close-packed structure. The crystal orientation of the c-axis of the $SmCo_5$ phase was perpendicular to the film surface, while the c-axis of the Y-phase was random with respect to the film surface. The interface between the $SmCo_5$ and Y was not matched. The thin film had a coercivity of 0.2 MA/m.

Example 4

Example of Addition Elements of Small Amount 90 g of $Sm_2Co_{17}$ powders, 10 μm in diameter, and 10 g of a Nd alloy, containing 0.2 wt % of Zr, were mixed and consolidated in a magnetic field. The green compact was sintered in vacuum at 1150° C. for two hours and cooled to room temperature. The resulting sintered mass was made up of a $Sm_2Co_{17}$ major phase and a Nd—Zr alloy grain boundary phase, with the interface between the two matching with each other. The sintered product had a coercivity of 1.1 MA/m.

Comparative Example 4

90 g of $Sm_2Co_{17}$ powders, having a grain diameter of 10 μm, and 10 g of Nd powders, were mixed and consolidated in a magnetic field. The green compact was sintered in vacuum at 1150° C. for two hours and cooled to room temperature. The resulting sintered mass was made up of a $Sm_2Co_{17}$ major phase and a Nd—Zr alloy grain boundary phase. Many lamination defects or dislocations were observed in the vicinity of the interface between the two being not, with the interface between the two mismatching with each other. The sintered product had a coercivity of 0.4 MA/m.

B[0055]

A starting material composed of 13.0 at % of Nd and 6.5 at % of B, the balance being Fe and inevitable impurities, was loaded in a quartz tube having an orifice diameter of 0.3 mm and fused by high frequency heating in an Ar gas atmosphere. The resulting molten material was ejected on the surface of a copper roll rotating at a roll peripheral speed of 20 m/s to produce a rapid solidification thin strip. This thin strip was crushed to a coarse size to pass through a 300 μm mesh and heat-treated in an Ar atmosphere at 600° C. for 30 minutes. The resulting mass was cooled to room temperature at a cooling rate of 100° C./min. The resulting small pieces of the crushed magnet were sampled to prepare a specimen for a transmission electron microscope by ion milling in Ar. The specimen was observed under the microscope and found to be of a mean crystal grain size of 75 nm. The grain boundary phase in the specimen was of a thickness of 4 nm and was Nd—Fe alloy of a face-centered cubic structure. The magnetic properties of the resulting magnet powders following magnetization are shown in Table 1.

Comparative Example 5

The small pieces of the coarse particle size, obtained in Example 5, were directly sampled and observed under a transmission electron microscope. The specimen was found to be of a mean crystal size of 72 nm. A grain boundary phase in the specimen was of a thickness of 3 nm and was an amorphous Nd—Fe alloy. The magnetic properties of the resulting magnet powders following magnetization are shown in Table 1.

TABLE 1

| | Crystal structure of grain boundary phase | Magnetic Properties | | | |
|---|---|---|---|---|---|
| | | Br (kG) | (BH)max (MGOe) | iHc (kOe) | bHc (kOe) |
| Ex. 5 | Face-centered Cubic | 8.6 | 12.6 | 13.8 | 6.8 |
| Comp. Ex. 5 | Amorphous | 7.2 | 8.7 | 6.3 | 3.5 |

As may be seen from the results of Table 1, comparison of magnetic properties of the R-TM-B based permanent magnet having the amorphous structure of the grain boundary phase and the R-TM-B based permanent magnet having the face-centered cubic structure of the grain boundary phase, with the crystal grain size of the two magnets being approximately equal, reveals that the magnet having the grain boundary phase of the face-centered cubic structure has magnetic properties particularly superior in coercivity.

Example 6

A starting material composed of 14.0 at % of Nd, 3.0 at % of Co and 7.0 at % of B, with the balance being Fe and inevitable impurities, was melted by high frequency heating in an Ar gas atmosphere to prepare an alloy. This alloy was roughly crushed and pulverized by a jaw crusher and a disc mill to not more than 420 μm. The resulting powders were further pulverized by a jet mill to produce fine powders with a mean particle size of 3 μm. The resulting fine powders were fed to a die of 15 mm×20 mm in size and consolidated by pressing under pressure of 1.5 ton/$cm^2$ along the direction of depth under magnetic orientation in a magnetic field of 11 kOe. The green compact was taken out and heated to 1100° C. in vacuum and maintained thereat for two hours by way of sintering. After the end of sintering, the sintered product was cooled to 800° C. at a cooling rate of 200° C./minute and subsequently cooled to 300° C. at a rate of 100° C./minute. Then, as Ar was introduced, the sintered product was cooled to room temperature to obtain a sintered magnet. Although the produced sintered product was reduced in size due to contraction as compared to the green compact, there was noticed no cracking, creasing nor deformation. The sintered magnet was held in vacuum at 500° C. for two hours and allowed to cool to room temperature at a cooling rate of 20° C./minute. The magnetic properties of the resulting sintered magnet following magnetization are shown in Table 2.

Also, small pieces of the resulting magnet were sampled to prepare a specimen for a transmission electron microscope by ion milling in Ar. The specimen was observed under the microscope and found that the specimen was of a mean crystal grain size of 12 μm and that a grain boundary phase having a thickness of 14 nm in the specimen was a Nd—Fe alloy having a face-centered cubic structure. FIG. 3 is a high-resolution transmission electron microscope photo showing the vicinity of the interface of the major phase and the grain boundary phase. On the right and left sides are shown the lattice images of the $R_2TM_{14}B$ major phase and the R-TM grain boundary phase, respectively. These two contact with each other on the interface. FIG. 4 shows an image of diffraction pattern of transmitted electron beam scattered from selected area on the $R_2TM_{14}B$ major phase in the right side of FIG. 3. As a result of analyses, the diffraction points can be represented by indices of a tetragonal system with lattice constants a=0.88 nm and c=1.22 nm, as shown in FIG. 4. It is seen from these indices that the direction of incidence of an electron beam can be represented as follows:

[110]

FIG. 5 shows an image of diffraction pattern of transmitted electron beam scattered from selected area on the R-TM grain boundary phase in the left side of FIG. 3. As a result of analyses, the diffraction points can be represented by indices of a tetragonal system with lattice constant a=0.52 nm, as shown in FIG. 5. It is seen from these indices that the direction of incidence of an electron beam can be represented as [001].

The relative crystallographic orientation of the major and grain boundary phases on the interface shown in FIGS. 3 to 5 may be expressed as follows:

(001) major phase//(110) grain boundary phase and
[110] major phase//[001] grain boundary phase The deviation in the relative orientation was within 5° from parallel. Similarly, the crystallographic orientation of the grain boundary phase in the vicinity of the interface to the major phase, analyzed on a selected area diffraction pattern, indicated that, in a majority of sites of observation, there was obtained the relation of the crystallographic orientation of one of the sets of (A) to (C) above.

Comparative Example 6

The sintered magnet, obtained by Example 6, was sampled without heat treatment and observed under a transmission electron microscope. It was found that the sample was of a mean crystal grain size of 12 μm, and that a grain boundary phase in the sample was of a thickness of 14 nm and was a Nd—Fe alloy having a face-centered cubic structure However, analyses of the crystallographic orientation of the grain boundary phase in the vicinity of the interface to the major phase by a selected area diffraction pattern indicated that no specified relative orientation prevailed. The magnetic properties of the as-magnetized sintered magnet are shown in Table 2.

TABLE 2

| | Magnetic Properties | | | |
|---|---|---|---|---|
| | Br (kG) | (BH)max (MGOe) | iHc (kOe) | bHc (kOe) |
| Ex. 6 | 13.5 | 42.7 | 15.3 | 13.8 |
| Comp. Ex. 6 | 12.1 | 34.2 | 7.2 | 5.9 |

It may be seen from the results of Table 2 that, if the magnetic properties of R-TM-B based permanent magnet having substantially the same crystal grain size and substantially the same crystal structure of the grain boundary phase are compared to each other, magnetic properties particularly superior in coercivity may be manifested if there is a specified relative orientation between the major phase and the grain boundary phase.

Example 7

A starting material composed of 13.0 at % of Nd, 3.0 at % of Co and 6.5 at % of B, the balance being Fe and inevitable impurities, was loaded in a quartz tube having an orifice diameter of 0.3 mm and fused by high frequency heating in an Ar gas atmosphere. The resulting molten material was ejected on the surface of a copper roll rotating at a roll peripheral speed of 20 m/s to produce a rapid solidification thin strip. This thin strip was crushed to a coarse size to pass through a 300 μm mesh and heat-treated in an Ar atmosphere at 600° C. for 30 minutes. The resulting mass was cooled to room temperature at a cooling rate of 100° C./min. The resulting small pieces of the magnet powders were sampled to prepare a specimen for a transmission electron microscope by ion milling in Ar. The specimen was observed under the microscope and found to be of a mean crystal grain size of 78 nm and found that the grain boundary phase in the specimen was of a thickness of 4 nm and was $Nd_3Co$ alloy having a rhombic structure. The magnetic properties of the resulting magnet powders following magnetization are shown in Table 3.

Comparative Example 7

The small pieces of the coarse particle size of the rapid solidification thin strip, obtained in Example 7, were directly sampled and observed under a transmission electron microscope. The specimen was found to be of a mean crystal size of 74 nm and found that the grain boundary phase in the specimen was of a thickness of 3 nm and amorphous Nd—Fe—Co alloy. The magnetic properties of the resulting magnet powders following magnetization are shown in Table 3.

TABLE 3

| | Crystal structure of grain boundary phase | Magnetic Properties Br (kG) | (BH)max (MGOe) | iHc (kOe) | bHc (kOe) |
|---|---|---|---|---|---|
| Ex. 7 | Rhombic | 8.4 | 11.8 | 12.9 | 6.4 |
| Comp. Ex. 7 | Amorphous | 6.82 | 7.9 | 5.8 | 3.2 |

As may be seen from the results of Table 3, comparison of magnetic properties of the R-TM-B based permanent magnet having the amorphous or rhombic structure of the grain boundary phase and the R-TM-B based permanent magnet having the rhombic structure of the grain boundary phase, with the crystal grain size of the two magnets being approximately equal, reveals that the magnet having the rhombic structure is particularly superior in coercivity thus displaying particularly superior magnetic properties.

Example 8

A starting material composed of 14.0 at % of Nd, 3.0 at % of Co and 7.0 at % of B, with the balance being Fe and inevitable impurities, was melted by high frequency heating in an Ar gas atmosphere to prepare an alloy. This alloy was roughly crushed and pulverized by a jaw crusher and a disc mill to not more than an 420 μm. The resulting powders were further pulverized by a jet mill to produce fine powders with a mean particle size of 3 μm. The resulting fine powders were fed to a die of 15 mm×20 mm and consolidated by pressing under a pressure of 1.5 ton/cm$^2$ along the direction of depth under magnetic orientation in a magnetic field of 11 kOe. The green compact was taken out and heated to 1100° C. in vacuum and maintained thereat for two hours by way of sintering. After the end of sintering, the sintered product was cooled to 800° C. at a cooling rate of 200° C./minute and subsequently cooled to 300° C. at a rate of 100° C./minute. Then, as Ar was introduced, the sintered product was cooled to room temperature to obtain a sintered magnet. Although the produced sintered product was reduced in size due to contraction as compared to the green compact, there was observed no cracking, creasing nor deformation. The sintered magnet was held in vacuum at 500° C. for two hours and allowed to cool to room temperature at a cooling rate of 20° C./minute. The magnetic properties of the resulting sintered magnet following magnetization are shown in Table 4.

Also, small pieces of the resulting magnet were sampled to prepare a specimen for a transmission electron microscope by ion milling in Ar. The specimen was observed under the microscope and found to be a mean crystal grain size of 12 μm and found that the grain boundary phase in the sample was of a thickness of 12 nm and was $Nd_3Co$ intermetallic compound having a rhombic structure. Similarly, the crystallographic orientation of the grain boundary phase in the vicinity of the interface to the major phase, analyzed by a selected area diffraction, indicated that, in a majority of sites of observation, there was obtained the relation of the crystallographic orientation of one of the sets of (F) to (I) aforementioned.

Comparative Example 8

The sintered magnet, obtained by Example 8, was sampled without heat treatment and observed under a transmission electron microscope. It was found that the sample was of a mean crystal grain size of 12 μm and that a grain boundary phase in the sample was of a thickness of 12 nm and was $Nd_3Co$ intermetallic compound having rhombic structure However, analyses of the crystallographic orientation of the grain boundary phase in the vicinity of the interface to the major phase by a selected area diffraction pattern indicated that no specified relative orientation prevailed. The magnetic properties of the as-magnetized sintered magnet are shown in Table 4.

TABLE 4

| | Magnetic properties Br (kG) | (BH)max (MGOe) | iHc (kOe) | bHc (kOe) |
|---|---|---|---|---|
| Ex. 8 | 13.4 | 42.5 | 16.1 | 14.2 |
| Comp. Ex. 8 | 11.8 | 34.7 | 7.6 | 6.1 |

It may be seen from the results of Table 4 that, if the magnetic properties of R-TM-B based permanent magnet having substantially the same crystal grain size and substantially the same crystal structure of the grain boundary phase are compared to each other, magnetic properties particularly superior in coercivity may be manifested if there is a specified relative orientation between the major phase and the grain boundary phase.

Example 9

A starting material composed of 13.0 at % of Nd and 6.5 at % of B, the balance being Fe and inevitable impurities, was loaded in a quartz tube having an orifice diameter of 0.3 mm and fused by high frequency heating in an Ar gas atmosphere. The resulting molten material was ejected on the surface of a copper roll rotating at a roll peripheral speed of 20 m/s to produce a rapid solidification thin strip. This thin strip was crushed to a coarse size to pass through a 300 μm mesh and heat-treated in an Ar atmosphere at 600° C. for 30 minutes. The resulting mass was cooled to room temperature at a cooling rate of 100° C./minute. The resulting small pieces of the crushed $R_2TM_{14}B$ based magnet powders contained 2.3 at % of O captured during the process. This O was to be a source for O in the R-TM-O compound. A small piece of the produced magnetic powders was sampled to prepare a specimen for a transmission electron microscope by ion milling in Ar. The specimen was observed under the microscope and found to be a mean crystal grain size of 74 nm and the grain boundary phase in the specimen was of a thickness of 5 nm and was a Nd—Fe—O alloy having a face-centered cubic structure. The magnetic properties of the resulting magnet powders following magnetization are shown in Table 5.

Comparative Example 9

The small piece of the coarse particle size, obtained in Example 9, was directly sampled and observed under a transmission electron microscope. The specimen was found to be of a mean crystal size of 73 nm and that the grain boundary phase in the specimen was of a thickness of 4 nm and was an amorphous Nd—Fe alloy. The magnetic properties of the resulting magnet powders following magnetization are shown in Table 5.

TABLE 5

| | Crystal structure of grain boundary phase | Magnetic Properties Br (kG) | (BH)max (MGOe) | iHc (kOe) | bHc (kOe) |
|---|---|---|---|---|---|
| Ex. 9 | Face-centered Cubic | 8.7 | 12.8 | 12.5 | 6.5 |
| Comp. Ex. 9 | Amorphous | 6.9 | 8.5 | 6.1 | 3.4 |

As may be seen from the results of Table 5, comparison of magnetic properties of the R-TM-B based permanent magnet having the amorphous structure of the grain boundary phase and those of the R-TM-B based permanent magnet having the face-centered cubic structure of the grain boundary phase, with the crystal grain size of the two magnets being approximately equal, reveals that the magnet having the face-centered cubic structure is particularly superior in coercivity thus displaying superior magnetic properties.

Example 10

A starting material composed of 14.0 at % of Nd, 3.0 at % of Co and 7.0 at % of B, with the balance being Fe and inevitable impurities, was melted by high frequency heating in an Ar gas atmosphere to prepare an alloy. This alloy was roughly crushed and pulverized by a jaw crusher and a disc mill to not more than 420 μm. The resulting powders were further pulverized by a jet mill to produce fine powders with a mean particle size of 3 μm. The resulting fine powders were fed to a die of 15 mm×20 mm and consolidated by pressing under a pressure of 1.5 ton/cm$^2$ along the direction of depth under magnetic orientation in a magnetic field of 11 kOe. The green compact was taken out and heated to 1100° C. in vacuum and maintained thereat for two hours by way of sintering. After the end of sintering, the sintered product was cooled to 800° C. at a cooling rate of 200° C./minute and subsequently cooled to 300° C. at a rate of 100° C./minute. Then, as Ar was introduced, the sintered product was cooled to room temperature to obtain a sintered magnet. Although the produced sintered product was reduced in size due to contraction as compared to the green compact, there was observed no cracking, creasing nor deformation. The sintered magnet was held in vacuum at 500° C. for two hours and allowed to cool to room temperature at a cooling rate of 20° C./minute. The produced sintered magnet contained 4.5 at % of O mainly captured during the pulverization process. This O was to serve as an O source of the R-TM-O compound. The magnetic properties of the resulting sintered magnet following magnetization are shown in Table 6.

Figure 7:
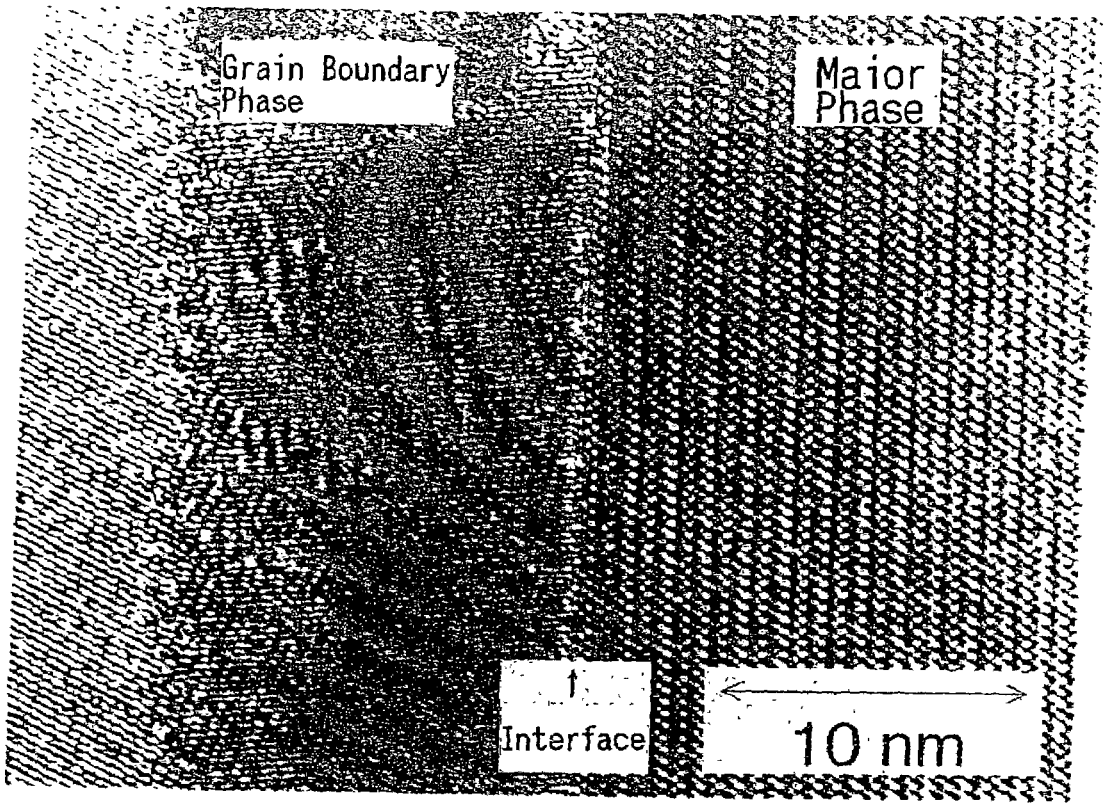
FIG. 7 is a photograph of electronic microscope of a permanent magnet according to Ex. 10 of the present invention in which the major phase is matched with the grain boundary phase.
Figure 8:
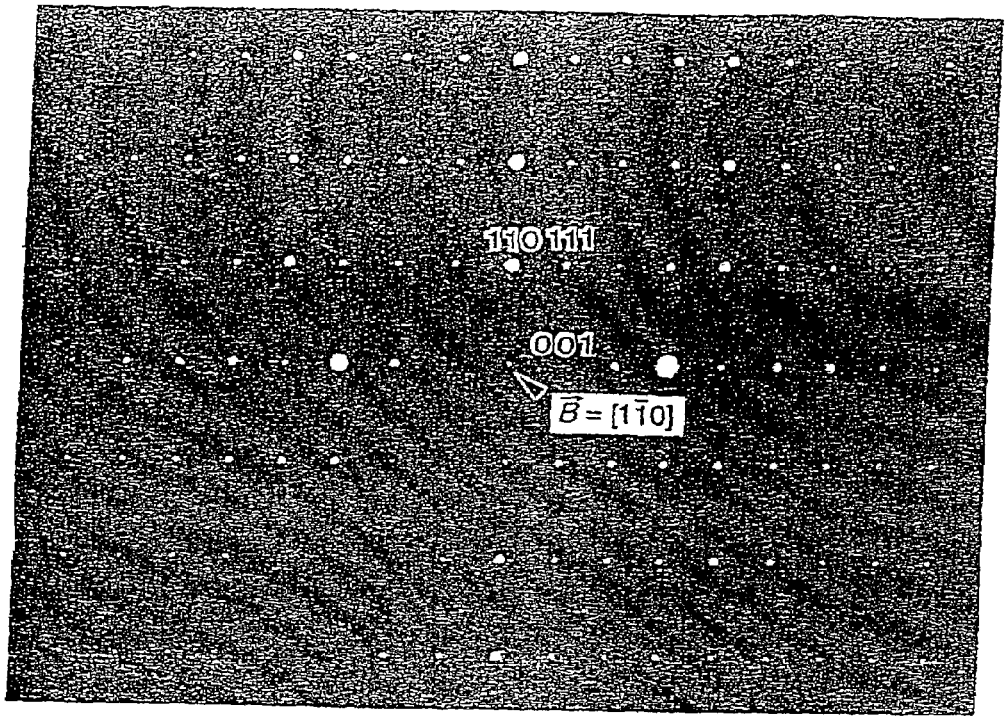
FIG. 8 is a photograph of electronic microscope showing an image of diffraction pattern of transmitted electron beam scattered from selected area on the major phase side shown in FIG. 7.

Also, small pieces of the resulting magnet were sampled to prepare a specimen for a transmission electron microscope by ion milling in Ar. The specimen was observed under the microscope and found to be of a mean crystal grain size of 12 μm and found that the grain boundary phase in the specimen was of thickness of 15 nm and was Nd—Fe—O alloy having a face-centered cubic structure. FIG. 7 is a high-resolution transmission electron microscope photo showing the vicinity of the interface of the major phase and the grain boundary phase. On the right and left sides are shown the lattice images of the $R_2TM_{14}B$ major phase and the R-TM-O grain boundary phase, respectively. These two contact with each other on the interface. FIG. 8 shows an image of diffraction pattern of transmitted electron beam scattered from selected area on the $R_2TM_{14}B$ major phase shown in the right side of FIG. 7. As a result of analyses, the diffraction points can be represented by indices of a tetragonal system with lattice constants a=0.88 nm and c=1.22 nm, as shown in FIG. 8. It is seen from these indices that the direction of incidence of an electron beam can be represented as follows:

[110]

Figure 9:
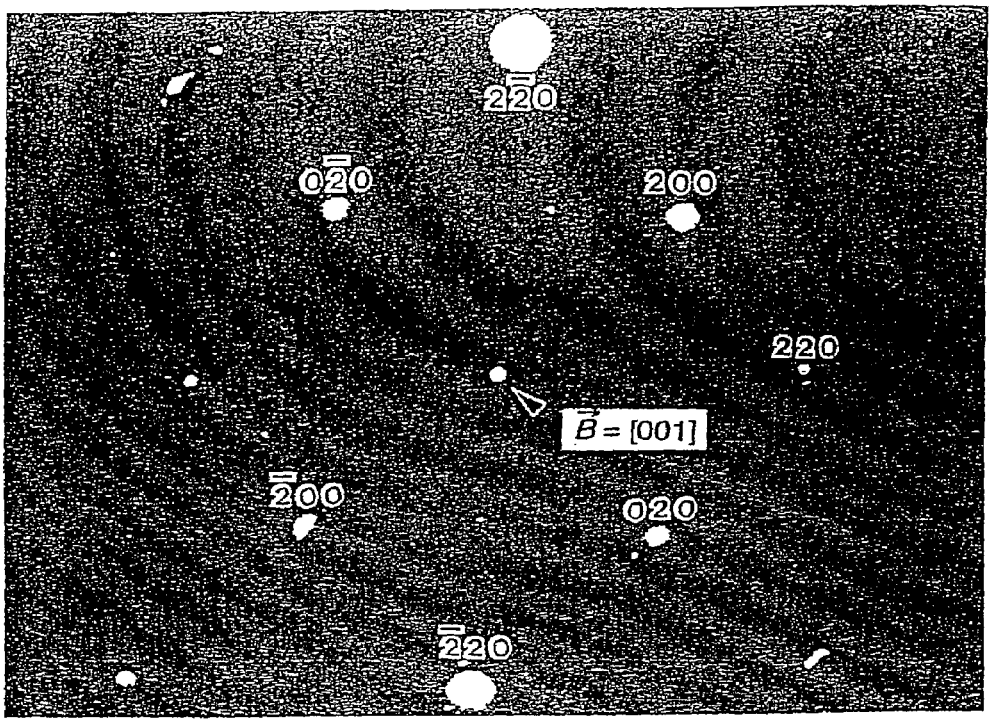
FIG. 9 is a photograph of electronic microscope showing an image of diffraction pattern of transmitted electron beam scattered from selected area on the grain boundary phase side shown in FIG. 7.

FIG. 9 shows an image of diffraction pattern of transmitted electron beam scattered from selected area on the R-TM grain boundary phase shown in the left side of FIG. 7. As a result of analyses, the diffraction points can be represented by indices of a face-centered cubic system with a lattice constant a=0.54 nm, as shown in FIG. 9. It is seen from these indices that the direction of incidence of an electron beam can be represented as [001]. The relative crystallographic orientation of the major and grain boundary phases on the interface shown in FIGS. 7 to 9 may be expressed as follows:

(001)major phase//(110)grain boundary phase and
[110]major phase//[001]grain boundary phase The deviation in the relative orientation was within 5° from parallel. Similarly, the crystallographic orientation of the grain boundary phase in the vicinity of the interface to the major phase, analyzed by a selected area diffraction pattern, indicated that, in a majority of sites of observation, there was obtained the relation of the crystallographic orientation of one of the sets of (A) to (C) aforementioned.

Comparative Example 10

The sintered magnet, obtained by Example 10, was sampled without heat treatment and observed under a transmission electron microscope. It was found that the sample was of a mean crystal grain size of 12 μm and that a grain boundary phase in the sample was a thickness of 15 nm and was Nd—Fe—O compound having a face-centered cubic structure. However, analyses of the crystallographic orientation of the grain boundary phase in the vicinity of the interface to the major phase by a selected area diffraction pattern indicated that no specified relative orientation prevailed. The magnetic properties of the as-magnetized sintered magnet are shown in Table 2.

TABLE 6

| | Magnetic Properties Br (kG) | (BH)max (MGOe) | iHc (kOe) | bHc (kOe) |
|---|---|---|---|---|
| Ex. 10 | 13.4 | 42.5 | 14.8 | 13.5 |
| Comp. Ex. 10 | 12.0 | 34.1 | 7.1 | 5.6 |

It may be seen from the results of Table 6 that, if the magnetic properties of R-TM-B based permanent magnet having substantially the same crystal grain size and substantially the same crystal structure of the grain boundary phase are compared to each other, magnetic properties particularly superior in coercivity may be manifested if there is a specified relative orientation between the major phase and the near-by grain boundary phase.

Example 11

Starting materials composed of compositions shown in Table 7 were each high-frequency melted in an Ar gas atmosphere to produce an ingot. This ingot was rough-crushed and further pulverized in a jet mill to a mean particle size shown in Table 8. To 100 parts by weight of the magnetic powders of respective particle size grades were added 4 parts by weight of granular Ca metal of particle size up to 1 mm and mixed together. The resulting mixture was heat-treated for two hours at a temperature of Table 10 in vacuum.

The residual oxygen quantity and the magnetic properties of the produced magnetic powders are shown in Table 9. For comparison, the compositions of the powders obtained by the rapid solidification method below ("MQP" manufactured by MQI of USA), and powders obtained by the HDDR method below, are shown in Table 9, while the manufacturing conditions, the residual oxygen and the magnetic properties of the produced powders, are shown in Table 10.

Comparative Example 11A

Rapid Solidification Method

An ingot of the composition shown in Table 9 was high-frequency melted in an Ar gas in a quartz tube nozzle. The resulting liquid metal was ejected on a Cu rotating roll to produce supercooled ribbons, which were then pulverized to a mean particle size of 250 μm and heat-treated in the Ar gas at 650° C. for 15 minutes.

Comparative Example 11B

HDDR Method

An ingot having a composition shown in Table 9 was C for two hours and dehydrogenated in hydrogenated at 800° C. for one hour to magnetic powders which were then pulverized to a mean particle size of 400 μm.

TABLE 7

Composition of Ingot Starting Material

| | Ingot No. | $Nd_{2+X}Fe_{14}B$ X |
|---|---|---|
| NdFeB Compound | 1 | 0.0 |
| | 2 | 0.10 |
| | 3 | 0.20 |

TABLE 8

Mean Particle Size of Magnetic Powders

| | Ingot No. | Mean Particle Size (μm) | Residual Oxygen (ppm) |
|---|---|---|---|
| NdFeB Compound | 1 | 4.5 | 4200 |
| | 1 | 45.0 | 2400 |
| | 1 | 157.0 | 1100 |
| | 2 | 4.1 | 4600 |
| | 2 | 160.0 | 1500 |
| | 3 | 3.5 | 4800 |
| | 3 | 450.0 | 1300 |

TABLE 9

Composition of Powders by Rapid Solidification Method and HDDR Method (wt %)

| | Nd | Dy | Fe | Co | Ga | Zr | B | $O_2$ | C |
|---|---|---|---|---|---|---|---|---|---|
| Rapid Solidification Method MQP (B) | 26.5 | — | Bal. | 5.0 | — | — | 0.98 | 0.04 | 0.03 |
| HDDR Method | 27.5 | 0.7 | bal. | 14.8 | 0.5 | 0.14 | 1.01 | 0.10 | 0.03 |

TABLE 10

Manufacturing Conditions and magnetic properties

| | Sample No. | Ingot No. | Mean Particle Size (μm) | Metal for Impregnation | Heat Treatment Temperature (° C.) | Residual Oxygen (ppm) | Magnetic Properties Br (kG) | Magnetic Properties iHc (kOe) |
|---|---|---|---|---|---|---|---|---|
| Ex. 11 | 1 | 1 | 4.5 | Ca | 600 | 5200 | 12.6 | 10.7 |
| | 2 | 1 | 4.5 | Ca | 700 | 5300 | 12.5 | 14.3 |
| | 3 | 1 | 4.5 | Ca | 800 | 5300 | 12.5 | 12.9 |
| | 4 | 1 | 45.0 | Ca | 700 | 3000 | 10.5 | 17.7 |
| | 5 | 1 | 157.0 | Ca | 700 | 1400 | 8.2 | 21.5 |
| | 6 | 2 | 4.1 | Ca | 700 | 5800 | 12.3 | 15.5 |
| | 7 | 2 | 160.0 | Ca | 700 | 1800 | 10.1 | 22.4 |
| | 8 | 3 | 3.5 | Ca | 700 | 5900 | 12.0 | 22.9 |
| | 9 | 3 | 450.0 | Ca | 700 | 1600 | 7.8 | 7.1 |
| Com. Ex. 11A, 11B | Rapid Solidification Method | — | 250 | — | — | 400 | 8.5 | 9.5 |
| | HDDR Method | — | 400 | — | — | 1000 | 11.5 | 15.7 |

With the method of Example 11, the powders equivalent or even superior to those obtained by the rapid solidification method or the HDDR method, as Comparative Examples, could be obtained as shown in Table 10. Since the method of Example 11 is in need of a smaller number of steps and low in cost, the powders obtained in Example 11 are extremely useful for industrial application. In Example 11, a lower particle size grade gives higher magnetic properties. It may be presumed that, if the crystal grain size (mean particle size) exceeds 400 μm, such as sample No.9, it becomes difficult for Ca to be impregnated along the crystal grain boundary to reduce the coercivity to a lower value.

Example 12

The Ca metal was vacuum-deposited on magnetic powders of each the mean particle size of Example 11 to a film thickness of 5 μm and heat-treated in vacuum for two hours at a temperature shown in Table 11. The manufacturing conditions, residual oxygen and magnetic properties of the magnetic powders produced are shown in Table 11.

TABLE 11

Manufacturing Conditions and magnetic Properties

| | Sample No. | Ingot No. | Mean Particle Size (μm) | Vapor Depositioning Metal for Impregnation | Heat Treatment Temperature (° C.) | Residual Oxygen (ppm) | Magnetic Properties Br (kG) | Magnetic Properties iHc (kOe) |
|---|---|---|---|---|---|---|---|---|
| Ex. 12 | 1 | 1 | 4.5 | Ca | 700 | 5600 | 12.6 | 10.4 |
| | 2 | 1 | 45.0 | Ca | 700 | 3300 | 10.6 | 8.8 |
| | 3 | 1 | 157.0 | Ca | 700 | 1600 | 8.6 | 13.5 |
| | 4 | 2 | 4.1 | Ca | 700 | 6200 | 12.4 | 12.4 |
| | 5 | 2 | 160.0 | Ca | 700 | 2200 | 10.2 | 14.4 |
| | 6 | 3 | 3.5 | Ca | 700 | 6100 | 12.2 | 14.9 |
| | 7 | 3 | 450.0 | Ca | 700 | 1800 | 8.2 | 5.8 |

As may be seen from Table 11, powders of high coercivity are obtained even with the gas phase film forming method, such as vacuum deposition method.

Example 13

To 100 parts by weight of powders of the ingot No.2 of Example 11 with a mean particle size of 4.1 μm were added 4 parts by weight of the impregnating material shown in Table 12 and mixed together. The resulting mixture was heat-treated for two hours in vacuum at a temperature shown in Table 12. Magnetic properties of the magnetic powders produced are shown in Table 12. As may be seen from Table 12, magnetic powders of superior magnetic properties could be obtained with the method of Example 13 even if alloys or compounds of alkaline earth metals are used.

TABLE 12

Manufacturing Conditions and Magnetic Properties

| | Sample No. | Material for Impregnation: Material Name | Material for Impregnation: Crystal Structure | Material for Impregnation: Lattice Const. (A) | Heat Treatment Temperature (° C.) | Magnetic Properties Br (kG) | Magnetic Properties iHc (kOe) |
|---|---|---|---|---|---|---|---|
| Ex. 13 | 1 | Ca—Al Alloy | Face-centered Cubic | 4.70 | 600 | 12.2 | 13.5 |

TABLE 12-continued

Manufacturing Conditions and Magnetic Properties

| | Sample No. | Material for Impregnation: Material Name | Material for Impregnation: Crystal Structure | Material for Impregnation: Lattice Const. (A) | Heat Treatment Temperature (° C.) | Magnetic Properties Br (kG) | Magnetic Properties iHc (kOe) |
|---|---|---|---|---|---|---|---|
| | 2 | Sr—Ba Alloy | Face-centered Cubic | 5.53 | 700 | 12.0 | 12.7 |
| | 3 | $CaF_2$ | Fluorite type | 5.46 | 800 | 12.5 | 15.3 |
| | 4 | CaO | NaCl-type | 4.81 | 700 | 11.8 | 13.8 |
| | 5 | SrO | NaCl-type | 5.16 | 700 | 10.7 | 12.8 |
| | 6 | BaO | NaCl-type | 5.54 | 700 | 11.5 | 11.9 |

It should be noted that other objects of the present invention will become apparent in the entire disclosure and that modifications may be done without departing the gist and scope of the present invention as disclosed herein and appended herewith.

Also it should be noted that any combination of the disclosed and/or claimed elements, matters and/or items may fall under the modifications aforementioned.

What is claimed is:

1. A rare-earth magnetic powder having an intrinsic coercivity iHc of at least 17.7 kOe for use in bonded magnets, comprising a $R_2TM_{14}B$ phase and at least one alkaline earth metal selected from the group consisting of Ca, Sr and Ba present in an interface of said $R_2TM_{14}B$ phase, wherein R is a rare earth element or Y, and TM is a transition metal in a matched state relative to the $R_2TM_{14}B$ phase.

2. The rare-earth magnetic powder for bonded magnets as defined in claim 1, wherein said alkaline earth metal has a lattice constant a in a range of 4.7 to 5.7 Å.

3. The rare-earth magnetic powder for bonded magnets as defined in claim 1, wherein the crystallographic orientation in the vicinity of an interface between the magnetic phase and a grain boundary phase diffused with said alkaline earth metal is represented by at least one set of the following expressions (A) to (E):

(001)major phase//(110)grain boundary phase and [110]major phase//[001]grain boundary phase (A)

(001)major phase//(221)grain boundary phase and [110]major phase//[111]grain boundary phase (B)

(001)major phase//(111)grain boundary phase and [100]major phase//[110]grain boundary phase (C)

(001)major phase//(201)grain boundary phase and [110]major phase//[010]grain boundary phase (D)

(001)major phase//(22$\bar{3}$)grain boundary phase and [110]major phase//[110]grain boundary phase (E).

4. The rare-earth magnetic powder for bonded magnets as defined in claim 1, wherein the alkaline earth metal is present in an amount of 0.5 to 5 parts by weight of alkaline earth metal per 100 parts by weight of $R_2TM_{14}B$.

5. A rare-earth magnetic powder having an intrinsic coercivity iHc of at least 17.7 kOe for use in bonded magnets, the rare-earth magnetic powder comprising polycrystalline grains of $R_{2+x}TM_{14}B$ and at least one alkaline earth metal selected from the group consisting of Ca, Sr and Ba diffused in a grain boundary of the polycrystalline grains of $R_{2+x}TM_{14}B$ so as to match with the $R_{2+x}TM_{14}B$ grains, wherein R is a rare earth element or Y, TM is a transition metal, and $0 \leqq x \leqq 0.3$.

* * * * *